United States Patent [19]

Katagiri et al.

[11] 4,265,596

[45] May 5, 1981

[54] AXIAL FLOW FAN WITH AUXILIARY BLADES

[75] Inventors: Haruo Katagiri; Kenji Fujikake; Katsuhito Yamada, all of Nagoya, Japan

[73] Assignee: Kabushiki Kaisha Toyota Chuo Kenkyusho, Nagoya, Japan

[21] Appl. No.: 962,695

[22] Filed: Nov. 21, 1978

[30] Foreign Application Priority Data

Nov. 22, 1977 [JP] Japan ..... 52-140135

[51] Int. Cl.[3] ..... F04D 29/38; F04D 29/58

[52] U.S. Cl. ..... 416/236 A; 416/175

[58] Field of Search ..... 416/236 A, 236, 175

[56] References Cited

U.S. PATENT DOCUMENTS

| | | | |
|---|---|---|---|
| 1,066,988 | 7/1913 | Boutwell | 416/236 A |
| 1,834,888 | 12/1931 | Baughn | 416/236 |
| 2,010,094 | 8/1935 | Leinweber | 416/236 A |
| 3,193,185 | 7/1965 | Erwin et al. | 416/236 A |
| 4,108,573 | 8/1978 | Wagner | 416/236 A |
| 4,128,363 | 12/1978 | Fujikake et al. | 416/236 A |

FOREIGN PATENT DOCUMENTS

| | | | |
|---|---|---|---|
| 15510 | of 1908 | United Kingdom | 416/236 |

*Primary Examiner*—Everette A. Powell, Jr.
*Attorney, Agent, or Firm*—Oblon, Fisher, Spivak, McClelland & Maier

[57] ABSTRACT

An axial flow fan having auxiliary blades which includes a hub rotatably supported and driven by a drive source, a plurality of fan blades extending radially outwardly from the hub and at least one auxiliary blade projecting from an outer part on a suction and/or pressure surface of the fan blade and extending in the chord-length direction in such a manner that the leading region of the auxiliary blade is located nearer to the central axis of the fan than the trailing region thereof. A supplementary angle $\theta_0$ of an angle formed between a chord line connecting to a leading edge and a trailing edge of the outer auxiliary blade and a reference line decided by the shape or operation of the fan blade has the relation; $5° \leqq \theta_0 \leqq 40°$. A supplementary angle $\theta_N$ of an angle formed between a chord line connecting to a leading edge and a trailing edge of the inner auxiliary blade and a reference line decided by the shape or operation of the fan blade also has the relation; $18° \leqq \theta_n \leqq 50°$. The axial flow fan serves to produce a strong radial flow by auxiliary blades of the optimum positional relation as described and improves the aerodynamic performances of the fan such as the air flow rate, efficiency and noise level.

64 Claims, 27 Drawing Figures

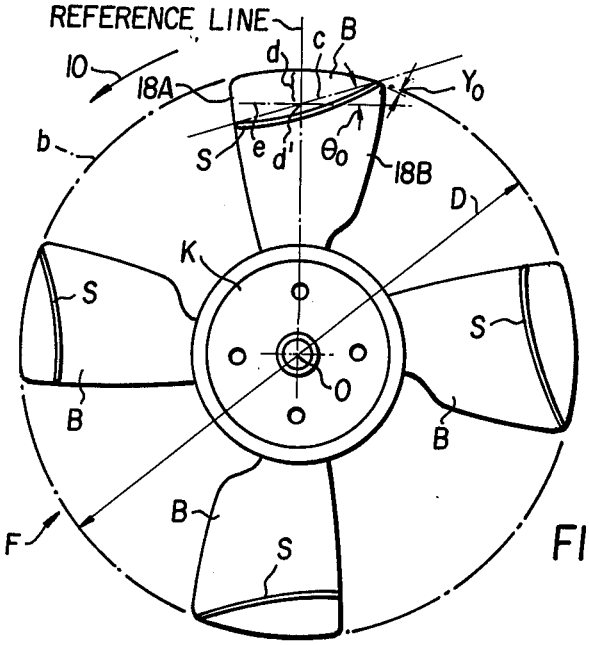
FIG. 1
FIG. 2
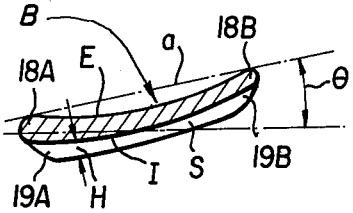
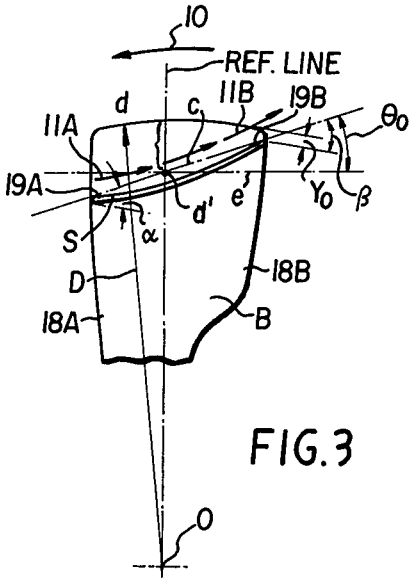
FIG. 3
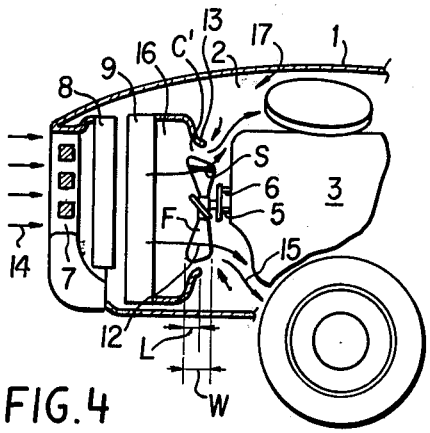
FIG. 4

AXIAL FLOW FAN WITH AUXILIARY BLADES

BACKGROUND OF THE INVENTION

1. Field of the Invention

This invention relates to an axial flow fan with auxiliary blades wherein the auxiliary blades are arranged in a most suitable manner relative to the fan blades.

2. Description of the Prior Art

Heretofore, some of the conventional axial flow fans have been provided with auxiliary blades on the surface of the fan blades. However, it was found to be difficult to form centrifugal flows of air positively in the axial flow fan, and none of the fans were found to be satisfactory from the viewpoints of aerodynamic performances such as the output air flow blowing efficiency and noise level. While centrifugal flows of air could be positively provided in our axial flow fan with auxiliary blades Japanese Utility Model Application Numbers 58988/1975, 58989/1975, 58990/1975, 152509/1975, 23737/1976, Patent Application Numbers 153066/1976, 153067/1976, and 153068/1976), further improvement can be expected in the air flow rate noise level, and other aerodynamic performances so that an optimum operating condition is realized.

In other words, the present invention has been developed after a series of experiments, conducted under visualization and analyses, for the purpose of obtaining an optimum positional relation of the auxiliary blades relative to the fan blades of the axial flow fan.

SUMMARY OF THE INVENTION

It is an object of the present invention to provide an axial flow fan which produces both an axial flow and a radial flow.

Another object of the present invention is to provide an axial flow fan which improves the aerodynamic performances of the fan such as the air flow rate, efficiency and noise level.

Still another object of the present invention is to provide an axial flow fan which has auxiliary blades of an optimum positional relation.

The objects of the present invention are further to provide an axial flow fan with auxiliary blades, wherein an optimum positional relation of the auxiliary blades is realized, the aerodynamic performances of the fan are improved, the noise level of the same is reduced, while such is made applicable to ventilating type systems as well as a pressure type system, and most suitably to various automobile vehicles as their cooling fans.

The present invention consists of a first aspect and second aspect.

According to the first aspect of the present invention, there is provided an axial flow fan with auxiliary blades, wherein the axial flow fan includes a plurality of fan blades extending radially outwardly from a driving shaft and at least one auxiliary blade provided on either the suction side surface or the pressure side surface of each fan blade so as to extend in the chord-length direction of the fan blade in a manner such that the leading end of the auxiliary blade is located nearer to the central axis of the fan than the trailing end thereof, and each of the auxiliary blades provided at the outermost position relative to the central axis of the fan is arranged to satisfy the relation:

$$5° \leqq \theta_0 \leqq 40°$$

wherein, $\theta_0$ is a supplementary angle of an angle formed between a chord line of the auxiliary blade and a reference line of the fan blade and wherein the chord line is a straight line extending from the leading end to the trailing end of the auxiliary blade with the reference line being a line extending from the central axis of the fan.

The present invention also provides the axial flow fan with an auxiliary blade which is arranged to satisfy an additional relation to that mentioned above and wherein;

$$0 \leqq Y_o \leqq 0.1D$$

where D is the outer diameter of the fan and $Y_o$ is a distance between the trailing end of the auxiliary blade and the outer diameter of the fan.

According to the above-described aspect of the invention, since the auxiliary blades are arranged as described, air flow along the surface of the fan blade is promoted by adding the centrifugal flow produced by the auxiliary blades to the air flow, occurrence of eddies and flow separations is prevented, flow of air is thus stabilized and smoothed with noise level being reduced, and a large air flow rate is forced by the auxiliary blades at the trailing end into the centrifugal direction of the fan blades.

More specifically, with regard to positional relation, by providing an auxiliary blade at an angular relation as described above with reference to the rotating direction of the axial flow fan, delivery of air at a high efficiency and low noise level can be obtained while preventing interference of air flow by adding the centrifugal air flow to the air flow without causing turbulence or flow-separation of air on the auxiliary blade.

Also, with regard to the positional relation $Y_o$ at the trailing edge of the auxiliary blade, in accordance with the above-described arrangement of the auxiliary blades, the peripheral part of the fan blade, of greater working capability, is effectively utilized, and by differentiating the peripheral speeds of the leading end and of the trailing end of the auxiliary blade remarkably, an air flow introduced into the leading end of the auxiliary blade is delivered at a high speed from the trailing end obliquely outwardly. Thus, a centrifugal flow is added to the axial flow, and therefore the blowing range and the air flow rate of the axial flow fan can be substantially increased. When a shroud is used in combination with the axial flow fan, reversing flow from the pressure side to the suction side through the clearance between the fan and the shroud is positively prevented by the centrifugal flow of air, and the net air flow rates of the suction or pressure can be thereby increased.

For the production of the centrifugal flow, the positional relation Y of the trailing end is important. This position in which utilization of peripheral speed is very useful is defined on the trailing side of the fan blade in the proximity of the outer diameter of the axial flow fan, so that the relation can be applied to various kinds of fan for improving the aerodynamic performances thereof.

According to the present invention, an auxiliary blade provided at the outermost position relative to the central axis of the fan and at least one auxiliary blade provided radially inwardly of said auxiliary blade are arranged so as to satisfy the relation:

$$10° \leqq \theta_o \leqq 40°$$

$$18° \leqq \theta_n \leqq 50°$$

where $\theta_o$ and $\theta_n$ are angles formed respectively between chords extending from the leading ends to the trailing ends of the auxiliary blades and circumferential lines which pass through intersecting points between the chord lines and a reference line extending from the central axis of the fan.

The present invention also serves to provide the axial flow fan with the auxiliary blades which are arranged to satisfy an additional relation to the above-mentioned relation wherein:

$$0 \leqq Y_o \leqq 0.1D$$

$$0.07D \leqq Y_n \leqq 0.11D$$

where D is the diameter of the fan while $Y_o$ and $Y_n$ are the distance from the trailing end of the outermost auxiliary blade to the outer diameter of the fan and the distance from the trailing edge of the innermost auxiliary blade to the trailing edge of the outermost auxiliary blade.

The characteristic feature of the second aspect of the present invention is in the effectively increased operative surface area of the fan blade in combination with a plurality of auxiliary blades. By this construction, the air flow rate can be increased and the noise level reduced as compared with a conventional axial flow fan without disturbing the air flow along the fan blade.

More specifically, by arranging the auxiliary blade provided at the outermost position relative to the central axis of the fan and at least one auxiliary blade provided radially inwardly of the auxiliary blade in accordance with the above-described relation, the air flow introduced into the leading end of the auxiliary blades is forced obliquely upwardly across the surface of the fan blade due to the revolution of the fan blade and the mounting angles of the auxiliary blades, so that a centrifugal flow of air is produced. The auxiliary blade provided radially inward of the first auxiliary blade is located at a root-mean-square effective diameter $$\sqrt{\frac{(\text{fan diameter})^2 + (\text{boss diameter})^2}{2}}$$

on the fan blade. Because of the positional difference between the leading and trailing ends of the auxiliary blade, a great difference in the peripheral speed can be obtained for these ends, and a centrifugal flow thereby produced is delivered to the backward surface part of the fan blade obliquely outwardly toward and along the inward surface of the outward auxiliary blade. This air flow along the inward surface of the outward auxiliary blade is added to another centrifugal flow produced along the outward surface of the outward auxiliary blade, thus producing an extremely strong and large quantity air flow in the centrifugal direction. This resultant air flow in the centrifugal direction is effectively further added along and to the axial air flow produced by the fan blades.

When the axial flow fan is combined with a shroud, any reverse flow from the pressure side to the suction side of the axial flow fan can be prevented by the centrifugal air flow caused by the auxiliary blades. Thus, the suction air flow rate can be substantially increased with simultaneous improvement of the aerodynamic performances such as a smooth and steady flow along the surface of the fan blade, prevention of eddies and separation of laminar flow, and reduction of the noise level, as in the case of this invention.

In the present invention, the axial flow fan includes a plurality of fan blades extending radially outwardly from a driving shaft of the fan, and at least one auxiliary blade provided on either the suction side surface or the pressure side surface of each fan blade to extend in the chord-length direction of the same in such a manner that the leading end of the auxiliary blade is located nearer to the central axis of the fan than the trailing end thereof with the height H of the auxiliary blade projecting from the surface of the fan blade being defined as $$0.02D \leqq H \leqq 0.055D$$

The selection of the height of the auxiliary blade in the above-described range enables effective control of the boundary layer, thus preventing the air flow from separation at the surface of the auxiliary blade, and, since the boundary layer is positively converted by the auxiliary blade into a centrifugal flow obliquely upward across the surface of the fan blade, aerodynamic performance of the axial flow fan such as the air flow and efficiency can be substantially improved. Furthermore, the elimination of separation of the boundary layer can remarkably reduce the noise level and maintain the strength of the axial flow fan and the auxiliary blades.

Furthermore, in an axial flow fan with auxiliary blades acccording to the present invention, where the axial flow fan includes a plurality of fan blades extending radially outwardly from a driving shaft of the fan and at least one auxiliary blade provided either on the suction side surface or the pressure side surface of each fan blade to extend in the chord-length direction of the same in such a manner that the leading end of the auxiliary blade is located nearer to the central axis of the fan than the trailing end thereof, the auxiliary blade may be so constructed that the blade has a center of curvature outwardly of the fan blade, and the camber line R within a range defined by the connections between the center of curvature and the leading and trailing ends of the auxiliary blade satisfies the relation:

$$R \geqq 0.2D$$

Herein, the camber line is a curve combining the middle points of the wall thickness of the auxiliary blade at a position between the leading end and the trailing end.

By the above-described construction of the auxiliary blade, air introduced into the suction side of the auxiliary blade and passed to the trailing end thereof is converted, due to the revolution of the fan and to the intake angle of the auxiliary blade, into an obliquely outwardly directing centrifugal flow of air whereby the flow separation from the surface of the auxiliary blade and bending of the fan blade during operation are prevented, stability and other aerodynamic performances are improved, and the noise level of the fan is reduced.

The axial flow fan with auxiliary blades of the present invention is adapted to be used as a cooling fan in an automotive vehicle. In this application, not only the cooling efficiency in a vehicle can be remarkably improved, but also, in combination with a shroud, the clearance between the axial flow fan and the shroud can be positively blocked by the centrifugal flow of air created by the auxiliary blade, thus preventing a reversing flow of air from passing from the pressure side to the suction side of the tip part of the fan blade and elevating the blowing capacity of the axial flow fan.

According to the present invention, wherein auxiliary blades are provided along the stream line on the fan blade in accordance with the above-described numerical relation, separation of air flow from the surface of the fan blade and auxiliary blade and creation of eddies and turbulance of air flow can be assuredly prevented, mutual interference between the effects can be effectively eliminated, and the specific noise of the fan can be substantially reduced. In addition, the creation of blade tip vortices during the reversing flow of air from the pressure side to the suction side of the fan blade can be prevented by the auxiliary blade, thus resulting in a further contribution to the reduction of the noise level.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein:

FIGS. 1 through 4 are views generally showing an axial flow fan constituting a first aspect of the present invention;

DETAILED DESCRIPTION OF THE PREFERRED EMBODIMENTS

Figure 6:
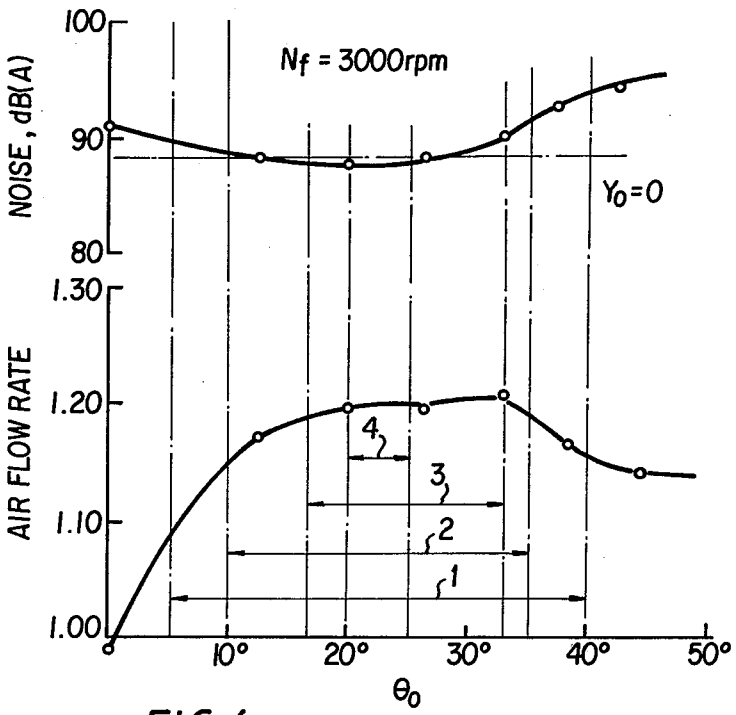
FIGS. 5 and 6 are graphical representations of characteristics of the first aspect of the invention.

Referring first to FIGS. 1 through 4, there is illustrated an embodiment of the axial flow fan F with auxiliary blades in the present invention which is adapted for an engine cooling system. In this embodiment, four fan blades B are provided to project radially outwardly from the rotating axis of a boss part K in an equally spaced apart relationship. The diameter D of this axial flow fan F is selected to 380 mm. Each of the fan blades B has a leading edge 18A and a trailing edge 18B in view of the rotating direction (indicated by an arrow 10). As shown in FIG. 1, the tip part of the fan blade B is of a configuration wherein the outermost point of the leading edge 18A and the outermost point of the trailing edge 18B are both in an outermost peripheral circle designated by b. The fan blade B has a pitch angle $\theta$ defined between a chord line designated by a, which passes through the leading edge 18A and the trailing edge 18B, and the rotating direction 10, which is selected approximately in a range of from 10° to 45° (in this example, 32° at the root-mean-square position) as best illustrated in FIG. 2.

An auxiliary blade S is provided on the suction side surface I of the fan blade B, at a position near the tip part of the fan blade B, to extend along the entire width of the fan blade B, so that the distance between the leading end 19A of the auxiliary blade and the center of rotation O of the fan is shorter than the distance between the trailing end 19B and the center of rotation O. As will be apparent from FIGS. 1 and 3, the auxiliary blade S is further constructed in such a manner that it is projected substantially perpendicularly from the surface of the fan blade B, extended along air flow 11A formed along the suction side surface I of the blade B when the fan F is rotated in the direction 10, from the leading edge 18A to the trailing edge 18B, and is curved radially outwardly.

The auxiliary blade S has a predetermined height H (approx. 13 mm) in a direction prependicular to the surface of the blade B. In addition, the auxiliary blade S is so arranged that the trailing end 19B thereof is spaced apart from the rotating circle b of the fan blade B by a distance $Y_o$ ranging from 0 to 0.1 D (from 0 to 38 mm), and that the auxiliary blade S is extended at an angle $\theta_o$ in a range of from 5° to 40° along the surface of the blade B with an inlet angle $\alpha$ at the leading end 19A ranging from 0° to 15° and an exit angle $\beta$ at the trailing end 19B ranging from 15° to 60°, thus being in a relation of $\alpha<\beta$. Herein, the distance $Y_o$ is defined by the spacing between the trailing end 19B of the auxiliary blade S and the rotating circle b of the tip of the blade B, the angle $\theta_o$ being defined as an angle formed between a chord C extending from the leading end to the trailing end of the auxiliary blade S and a circumferential line e passing through an intersecting point d' where the chord line intersects a reference line d which extends from the central axis O of the fan blade B and through such points approximately 2/5 times the chord lengths. Likewise, the inlet angle $\alpha$ is defined to be the inclination of the leading end 19A of the auxiliary blade S against the rotating direction of the fan, and the exit angle $\beta$ is defined to be the inclination of the trailing end 19B of the auxiliary blade S against the same direction of the fan.

The axial flow fan with auxiliary blade of the present invention may be applied to an automobile as shown in FIG. 4 as a part of its cooling system for the engine.

In the engine room 2 of an automobile 1 (only a part of which is indicated), the axial flow fan F bearing-supported by the engine 3 is coupled through a belt-pulley device 5 to the output shaft 6 of the engine 3. Forwardly from the axial flow fan F in view of the progressing direction of the automobile 1, a radiator 9, a condenser 8, and a radiator grill 7 are sequentially arranged. The axial flow fan F is selected to be of a suction type in its rotating direction and arrangement, creating air flows 11A and 11b by the rotation of the arrow direction 10, so that a cooling air flow 12 is produced to pass through the grill 7, condenser 8, and the radiator 9.

To the radiator 9, a shroud 13 having an inner diameter considerably greater than the rotating locus of the radially outermost part of the axial flow fan F is secured integrally, such that the shroud 13 covers the peripheral part of the axial flow fan F. By this arrangement the entire air flow directed by suction to the axial flow fan F is caused to pass through the radiator 9, and the air blowing capacity of the axial flow fan is also increased.

As described hereinabove, a predetermined clearance C' (ordinarily 20 mm on one side) is provided between the radially outermost part of the axial flow fan F and the inner surface of the shroud 13. This is due to the fact that the axial flow fan is supported by, and therefore vibrated with, the engine 3 while the shroud 13 is secured to the radiator 9, so that when mutual oscillation occurs there is a possibility of the two members being brought into contact with each other. Furthermore, between the axial flow fan F and those members such as the engine 3, radiator 9, and the like adjacent to the axial flow fan F, a predetermined clearance (more than 30 mm) is ordinarily provided for preventing the axial flow fan F from touching these members in case of axial movement of the axial flow fan F due to abrupt starting or stopping of the automobile or in the case where the axial flow fan F is deformed by a temperature variation or an application of a stress. As shown in FIG. 4, the automobile receives an air flow or ram wind 14 from the front side in the running time, and this flow 14 is added to the cooling flow 12 produced by the axial flow fan F, the resultant air flow being used for the cooling of the required parts of the vehicle.

The operation and advantageous effects of the axial flow fan F of the embodiment constituting the present invention will now be described in the case where the axial flow fan is applied to the above-mentioned engine cooling system of an automobile.

When the axial flow fan F constituting the invention is rotated in a direction designated by the arrows 10 in FIGS. 1 and 3, an axial air flow similar to that in the conventional axial flow fan can be obtained on the pressure side E of the fan blade B, while, on the suction side I where no recognizable blower action can be expected, an air flow oblique to the rotating direction of the fan, because of the inclination of the auxiliary blade S against the rotating direction, hence constituting a centrifugal flow of air created along the auxiliary blade S. Thus, on the pressure side 17 of the axial flow fan F, a mixed flow of the axial flow and the centrifugal flow is delivered at high efficiency and strength. In the axial flow fan F with the auxiliary blades of the present invention, auxiliary S is provided on the suction side surface I of the fan blade B at a position where a greatest amount of work can be expected, that is, at a position adjacent the tip part of the fan blade B where a greatest peripheral speed difference can be provided. More specifically, the auxiliary blade S is provided in a manner such that $Y_o$ is in a range of from 0 to 0.1 D (from 0 to 38 mm) and $\theta_o$ is in a range of from 5° to 40°. In other words, the auxiliary blade S is arranged on the surface of the blade of an automobile cooling fan in a way conforming to the natural air flow on the blade. For this reason, there is no fear of the flow along the surface of the blade being disturbed by the auxiliary blade, and a centrifugal flow is delivered from the trailing end 19B of the auxiliary blade S without causing eddies and separation adversely affecting the noise level. In this case, since the trailing end 19B is near the outermost peripheral circle b, a comparatively great difference in the peripheral speed can be taken between the leading end and the trailing end of the auxiliary blade, and therefore the air flow along the auxiliary blade is outwardly forcefully delivered from the trailing end 18B of fan blade.

By this centrifugally delivered flow added to the essentially axial flow, the blowing range and the air flow of the axial flow fan can be increased. When a shroud 13 is used in combination with the axial flow fan, reversing flow from the pressure side 17 to the suction side 16 through the clearance C' between the fan and the shroud is prevented by the above-mentioned centrifugal flow of air, and the cooling air 12 passing through the radiator 9 and the condenser 8 is increased.

Figure 5:
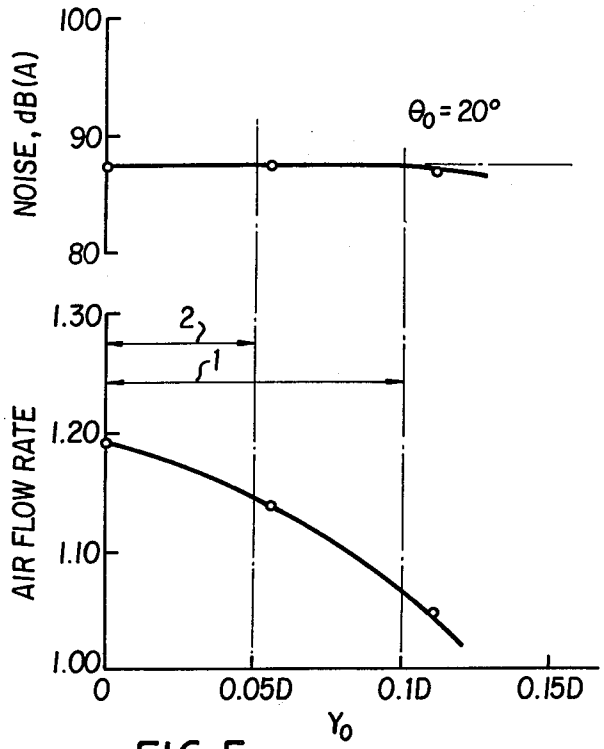

According to experiments in the present invention investigating the effects of the attaching angle $\theta_o$ of the auxiliary blade and the effects of $Y_O$ when $\theta_o$ is 20°, the results shown in FIGS. 5 and 6 were obtained. In both FIG. 5 and FIG. 6, the air flow increasing rate was measured at rotating speeds $N_f$ of 1,000, 2,000, and 3,000 rpm and the noise level was measured at $N_f$=3,000 rpm at a position one meter forward from the axial flow fan.

More specifically, the abscissa of FIG. 5 indicates $Y_O$ corresponding to the position of the trailing end **19*b* of the auxiliary S relative to the fan diameter D, and the ordinate of FIG. 5 indicates the air flow rate increasing rate and the noise level compared with a conventional axial flow fan without auxiliary blades. Likewise, the abscissa of FIG. 6 indicates $\theta_o$ at which the auxiliary blade is secured to the fan blade B, and ordinate of FIG. 6** indicates the air flow increasing rate and the noise level compared with that of a conventional axial flow fan without auxiliary blades. The air flow rate increasing rate corresponds to the centrifugal flow component which is obtained by the provision of the auxiliary blades S.

It is made apparent from FIGS. 5 and 6 that in an axial flow fan wherein the distance $Y_O$ is 0 and $\theta_o$ is 20°, the difference between the peripheral speeds of the leading end and the trailing end of the auxiliary blade S can be selected so as to have a large value with resulting comparatively large relative speed of air at the trailing end 19B of the auxiliary blade S, which produces a strong centrifugal flow disposed obliquely along the surface of the fan blade B without disturbing air flow along the fan blade and hence reducing the noise level. Furthermore, in combination with the shroud 13, the reversing flow through the clearance C' can be eliminated by the centrifugal flow and the aerodynamic performances of the fan can be further improved.

From FIGS. 5 and 6, it is made apparent that the main factor affecting the noise level is the attaching angle $\theta_o$ of the auxiliary blade, and therefore the optimum range of $\theta_o$ is determined based on the occurrence of the turbulance eddies, and the separation or stripping. The most suitable value of $\theta_o$ has been found to be in a range of from 5° to 40° for high flow rate with low noise.

On the other hand, the aerodynamic performance such as air flow and the like largely depend on the values of $Y_O$ and $\theta_o$, particularly of $Y_O$, and are more desirable when the distance $Y_O$ between the trailing end 19B of the auxiliary blade S and the outermost peripheral circle b is nearer to zero. The reason for this resides in the fact that when the distance $Y_O$ is nearer to zero, the amount of the centrifugal flow from the trailing end 19B increases.

The present invention also involved other experiments on axial flow fans with auxiliary blades S, wherein $Y_O$ is a value exceeding 0.1 D, and on the other axial flow fans with auxiliary blades wherein $\theta_o$ is a value from 5° to 33°. As a result, it was found that as the positional relation is apart from the air flow line on the surface of the fan blade B, the noise level tends to be increased with eddies and separation being created. When the trailing end 19B of the auxiliary blades S approaches the axial center of the fan, the aerodynamic performances is less desirable although the noise level is greatly varied. In other words, although the direction of the air flow is not varied, the aerodynamic performances are decreased because the region in which there is the large difference of the peripheral speed can not be used.

According to numerous experiments and analyses regarding variations of positional relations such as the securing distances and the attaching angles of the auxiliary blades on the axial flow fan, the optimum positional relation which has practical satisfactory performances and effects has thus been obtained. The reason why the aforementioned relation or ranges are so set will now be described. For example, the differences of the performance and effects of the attaching angle $\theta_o$ of the auxiliary blades to the fan blade has been investigated when the distance $Y_O$ is 0. The result as shown in FIG. 6 where the diversity of the performances by the angle $\theta_o$ appears remarkable.

As will be apparent from FIG. 6, by the provision of the auxiliary blade S on the fan blade B, the variable range of the noise level is divided into a low noise region and a high noise region, although the increase in the air flow rate is conspicuous.

This means that when the disposition of the auxiliary blade S on the fan blade B coincides with the direction of air flow on the surface of the fan blades B, a high air flow and low noise can be attained, but when the direction of the auxiliary blade S interferes the air flow, eddies tend to be created, impaction sound against the auxiliary blade becomes high, and a high noise region occurs.

Since in a region wherein the air flow is higher than that of the conventional axial flow fan by 10%, while the noise level is higher than that of the conventional axial flow fan by 1 dB, and also in another region wherein the wind delivery is 20% higher while the noise level is 1.5 dB higher, the noise level is actually reduced from that of the conventional axial flow fan when compared on an equal air flow basis and these two regions can be used for defining the attaching angle $\theta_o$. That is, the range starting from 5° and ending at 40° is assured to be suitable for defining the attaching angle $\theta_o$ of the auxiliary blade S.

With regard to the supplementary angle $\theta_o$ of the auxiliary blade fan of the present invention, the range starting from 5° and ending at 40° is proper for practical use as shown in FIG. 6 by the arrow ①. Considering the increase of the air flow rate, the suitable range of $\theta_o$ is in a range of from 10° to 35° as shown in FIG. 6 by the arrow ②. By the relation of the noise and the air flow rate, the suitable range of $\theta_o$ is in a range of from 17° to 33° as shown in FIG. 6 by the arrow ③. Further, considering the noise level and the air flow rate, the optimum range of $\theta_o$ is in a range of from 20° to 25° as shown in FIG. 6 by the arrow ④.

On the other hand, with regard to the securing distance $Y_o$ of the auxiliary blade of the present invention, the range starting from 0 and ending at 0.1 D is proper for practical use as shown in FIG. 5 by the arrow ①. Considering the increase of the air flow rate, the suitable range of $Y_o$ is in a range of from 0 to 0.05 D as shown in FIG. 5 by the arrow 2 and the optimum securing distance is $Y_o=0$.

Accordingly, when comparing the noise level of an axial flow fan constituting the embodiment of the first aspect of the invention with that of the conventional axial flow fan without auxiliary blades on an equal air flow basis, an axial flow fan in a region of 7 to 8% higher air flow with an equal noise level has a practical noise level lower than the conventional axial flow fan by approximately 1 dB. Thus, in this region, the axial flow fan wherein the range of the distance $Y_o$ of the trailing end 19B of the auxiliary blade S to the diameter D of the fan blade is between 0 and 0.1 D and the range of the attaching angle $\theta_o$ of the auxiliary blade S to the fan blade B is between 5° and 33° is practical and allows for effective performances.

The character of the axial flow fan with the auxiliary blade of the first aspect of the present invention is to add the centrifugal flow produced by the auxiliary blade to the air flow produced by the conventional axial flow fan without the auxiliary blade and to provide desirable characteristics such as a magnification of the air flow region, an increase of the air flow rate and a decrease of the noise.

Namely, it is again noted that an object of the present invention is to produce positively the centrifugal flow by attaching the auxiliary blade, and thus the attaching angle $\theta_o$ of the auxiliary blade is important. Because the inclination of the auxiliary blade to the air flow most greatly affects the production of the centrifugal flow.

When the attaching angle $\theta_o$ is smaller than the above-mentioned range, the auxiliary blade is useless for producing the centrifugal flow further preventing the centrifugal flow. Therefore in a fan system of an automobile the centrifugal flow produced by the difference of the pressure between front and rear of the fan is prevented by the auxiliary blade at the surface of the blade, the air flow rate is reduced and higher noise occurs when the air flow bumps into the auxiliary blade. As a result, practical use of the axial flow fan of this type is difficult.

Under the visualization of air flow and the observation of the air flow direction, the inventors of the present invention confirmed that when the auxiliary blade was provided at the pressure side of the fan blade and no resistance or contraction was at the pressure and suction sides, the air flow at the fan blade had an inclination of more than 5° to the direction of the rotation. Thus, it is desirable that the attaching angle $\theta_o$ of the auxiliary blade is more than 5°.

Generally, under visualization by an oil film, the inclination of the air flow at the surface of the fan blade is about 20°. On the basis of the above result, various experiments regarding the attachment of the auxiliary blade were carried out. The result is shown in FIG. 6.

Though the increase of the attaching angle $\theta_o$ is directed to producing a stronger centrifugal flow, the extreme increase of the attaching angle $\theta_o$ causes defects such as air separation from the auxiliary blade, reduction of air speed and centrifugal air flow rate, extraordinary increase of the motive power, fluctuation of the air fow and an extraordinary increase in noise. The limitation of the increase of the attaching angle $\theta_o$ is about 35° (practically about 40°).

It is necessary that the centrifugal flow produced by the auxiliary blade is directed to flow largely outwardly and forcefully. Therefore the arrangement position $Y_o$ of the auxiliary blade at the trailing edge part is important. Namely by setting the arrangement position $Y_o$ as near the diameter of fan blade as possible, the following advantages result.

(i) The delivering range of the centrifugal flow produced by the auxiliary blade becomes larger, so a wider range air flow can be obtained.

(ii) By using the outer part of the fan blade in which the working rate of the fan blade is larger, the difference of the peripheral speed of the air flow which is directed into and out from the auxiliary blade becomes larger, so the air flow diirected into the auxiliary blade is increased.

(iii) When the auxiliary blade is arranged at the trailing edge part of the blade, a stronger centrifugal flow than noted above (ii) is produced. This air flow prevents a tip vortex at the tip of the fan blade and reverse flow from the pressure side to the suction side through the clearance between the shroud and the fan blade such that suction air flow from the front of the fan increases.

In all the above-described experiments, the axial flow fan was combined with a shroud 13 with a relation:

$$0<L\leqq W$$

wherein W is the width of the fan blade B projected on an axial plane, and L is the depth of insertion of the axial flow fan into the shroud 13 from the minimum inner diameter side in the smaller diameter part to the enlarged inner diameter side of the shroud. Since a suitable insertion ratio L/W was determined to be in a range of from 2/5 to 4/5, with the most suitable ratio being 3/5, the axial flow fan was, during the above-described experiments, combined with a shroud at an insertion rate of 3/5.

Figure 7:
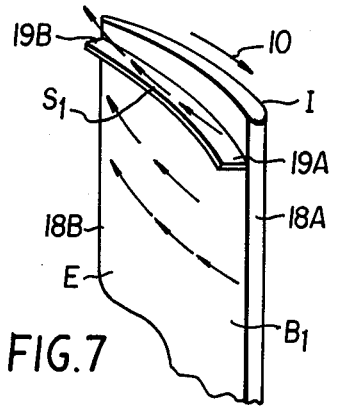
FIGS. 7 and 8 are views generally showing a modification of the first aspect.
Figure 8:
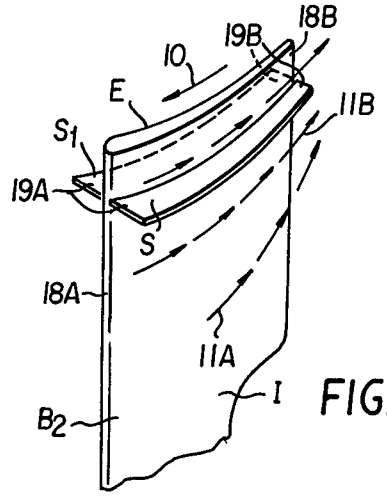

Although the present invention has been described in detail with the auxiliary blade S provided on the suction side surface I of the fan blade B, it is apparent that the auxiliary blade may also be provided on the pressure side surface E of the fan blade as shown in FIG. 7, or on both the suction side I and the pressure side E thereof as shown in FIG. 8. In both of the cases, however, the auxiliary blade or blades are positioned in the radially outer part of the fan blade B and extended across the entire width of the fan blade.

By provision for an auxiliary blade S1 on the pressure side surface E of the fan blade B1 as shown in FIG. 7, the air blowing effect in the centrifugal direction of the axial flow fan can be promoted on the pressure side 17 thereof, and a cumulative effect of the centrifugal flow and the axial flow can be obtained as well as preventing the effect of reversing flow through the gap between the fan B1 and the shroud 13, improvement of the efficiency of the axial flow fan, prevention of eddies and separation or stripping of air flow from the surfaces of the fan blade B1 and the auxiliary blade S1, and reduction of the noise level as in the case of the above-described example of the present invention.

In the case where auxiliary blades S and S1 are provided on the suction side I and the pressure side E of the fan blade B2 as shown in FIG. 8, the blowing effect in the centrifugal direction is further improved on both the suction side and the pressure side, thus providing a further improvement in the cumulative effect between the centrifugal flow and the axial flow caused by the fan blade B2 and showing greater improvement than in the example of FIG. 7.

Figure 9:
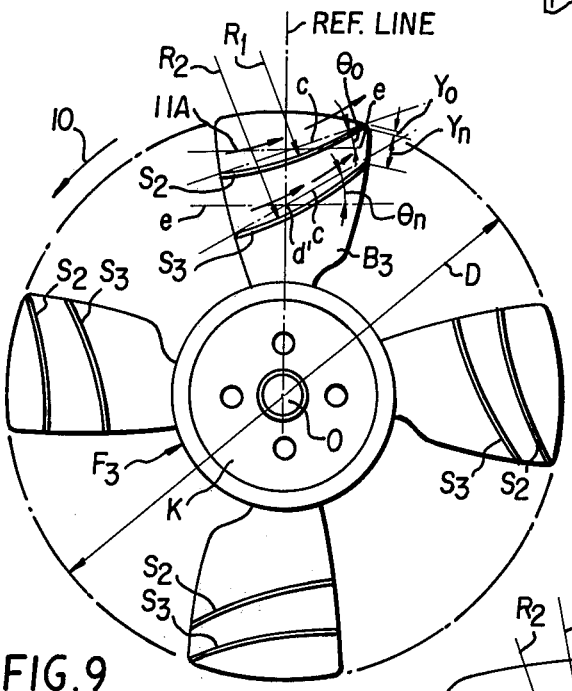
FIGS. 9 and 10 are views generally showing an axial flow fan constituting a second aspect of the invention.
Figure 10:
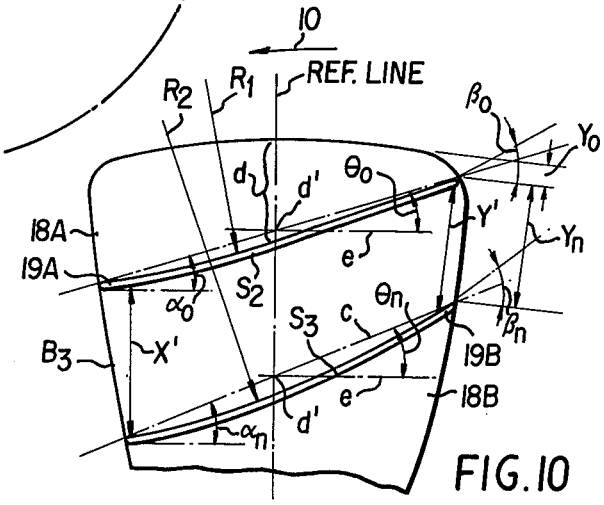

An axial flow fan with auxiliary blades constituting the second aspect of the present invention will now be described in detail with reference to FIGS. 9 through 13. As shown in FIGS. 9 and 10, there are provided on the suction side surface I of the fan blade B3 a first auxiliary blade S2 at the radially outermost position thereof and a second auxiliary blade S3 at a radially inward position with respect to the first auxiliary blade S2. In further description of the second aspect of the invention, similar parts as set forth in the first aspect will be designated by the same reference numerals and characters without describing the same in detail, and the description will be, for the most part, concentrated on the parts which are different from the first aspect.

The first auxiliary blade S2 is secured to the fan blade B3 in such a manner that the distance $Y_o$ between the trailing end 19B thereof and the fan diameter D is in a range of from 0 to 0.1D and the attaching angle $\theta_o$ thereof is in a range from 10° to 40°. The second auxiliary blade S3 is also secured to the fan blade B3 in such a manner that the securing distance $Y_n$ between the trailing ends 19B of the first and second auxiliary blades is in a range of from 0.07D to 0.11D and the attaching angle $\theta_n$ thereof is in a range of from 18° to 50°. Herein, the distance $Y_n$ is measured along with $Y_o$ from the trailing end 19B of the first auxiliary blade S2 to the trailing end 19B of the second auxiliary blade S3 in a direction toward the central axis of the axial flow fan, and the attaching angle $\theta_n$ is formed between a chord extending from the leading end 19A to the trailing end 19B of the auxiliary blade S3 and a circumferential line e passing through an intersecting part d' where the chord line intersects a reference line d extending from the central axis O of the fan blade B3 through those points having 40% of chord lengths.

The auxiliary blades S2 and S3 have respective heights in the direction of the thickness thereof, and are extended from the leading edge 18A to the trailing edge 18B of the fan blade B3 along the direction of air flow from 11A to 11B on the surface of the same blade as the fan is rotated in the arrow direction 10 indicated in FIGS. 9 and 10 such that the auxiliary blades S2 and S3 are curved radially outwardly. The auxiliary blades S2 and S3 have, at the leading edge 19A, inlet angles $\alpha_o$ and $\alpha_n$ (inclinations of the auxiliary blades S2 and S3 relative to the rotating direction of the axial flow fan) in a range approx. from 0° to 15°, and, at the trailing edge 19B, exit angles $\beta_o$ and $\beta_n$ (inclination of the auxiliary blades S2 and S3 relative to the rotating direction of the axial flow fan) in a range approx. from 15° to 60°.

The auxiliary blades S2 and S3 have a spacing X' between the leading ends thereof which is greater than the spacing Y' ($Y'=Y_n$) between the trailing ends thereof (such arrangement being termed unequal spacing). That is, the auxiliary blade S3 has an attaching angle $\theta_n$ and an exit angle $\beta_n$, both relative to the rotating direction of the axial flow fan, greater than the attaching angle $\theta_o$ and the exit angle $\beta_o$ of the auxiliary blade S2.

Thus, the axial flow fan constituting the embodiment of the second aspect of the invention, now designated at F3, has, on the suction side surface I of the fan blade B3, an auxiliary blade S2 provided radially outwardly and another auxiliary blade S3 provided radially inwardly therefrom. The first auxiliary blade S2 has a securing distance $Y_o$ of the trailing end thereof in a range of from 0 to 0.1D and an attaching angle $\theta_o$ in a range of from 10° to 40°, while the second auxiliary blade S3 has a securing distance $Y_n$ of the trailing end thereof in a range of 0.07D to 0.11D and an attaching angle $\theta_n$ in a range of from 18° to 50°, $\theta_n$ thus being greater than $\theta_o$. As a result, the effective areas for blowing operation of the auxiliary blades S2 and S3 can be increased, the speed and rate of the centrifugal flow can be elevated, and the air flow and the blowing efficiency of the axial flow fan can be substantially improved.

Since the exit angles $\beta_o$ and $\beta_n$ of the auxiliary blades S2 and S3 are made greater than the inlet angles $\alpha_o$ and $\alpha_n$, when the attaching angle $\theta_n$ is smaller than that of the above-mentioned range, the centrifugal flow cannot be produced and the air flow is disturbed, and when the attaching angle $\theta_n$ is larger than that of the above-mentioned range, the speed of the air flow from the auxiliary blade is reduced, the air flow rate is reduced and the noise is increased. By the relation of the auxiliary blades S2,S3, the useful range of the attaching angle $\theta_o$ is $10° \leqq \theta_o \leqq 32°$.

With regard to the securing distances $Y_0$ and $Y_n$, when one securing distance $Y_0$ is from 0 to 0.1D, the same effects as the axial flow fan with auxiliary blade of the first aspect of the present invention result. The centrifugal flow produced between the auxiliary blades S2 and S3 is smooth and outwardly with the securing distance $Y_n$ being from 0.07D to 0.1D. When the securing distance $Y_n$ is smaller than the above-mentioned range, the auxiliary blade becomes a resistance against the centrifugal flow, and when the securing distance $Y_n$ is larger than the above-mentioned range, centrifugal flow becomes weak and air flow becomes difficult along the under surface of the auxiliary blade S2.

Generally, the air flow at the surface of the blade of the axial flow fan $F_3$ includes some centrifugal flow produced by the centrifugal force of the rotation. When there is a resistance or contraction at the suction side or the pressure side of the fan blade, this centrifugal flow is very clearly produced. The centrifugal flow near the axis of rotation of the fan is greater in the outward part thereof than that near the diameter of the fan because the centrifugal flow is drawn to the tip part of the fan by the difference of the pressure between the part near the axis of the rotation and the part near the diameter of the fan where the speed of the pressure air flow is more rapid. Therefore the positional arrangement of the auxiliary blades S2, S3 is important. When the auxiliary blades S2, S3 are arranged along the air flow on the surface of the blade, the aerodynamic performance can be increased without disturbing the air flow. To provide this aerodynamic performance, the attaching angles $\theta_n$, $\theta_0$ need to satisfy the relation:

$$\theta_n \geqq \theta_0$$

By this relation (i.e. the attaching angle $\theta_n$ of the auxiliary blade S3 provided near the axis of the fan is larger than $\theta_0$), the strong centrifugal flow produced by the attaching angle $\theta_n$ is added to the air flow which flows along the under surface of the auxiliary blade S2 provided at the tip part of the fan blade, so the stronger centrifugal flow flows outwardly from the trailing end of the blade.

The relation between the attaching angle $\theta_n$ and the air flow is the same as that of the axial flow fan with the auxiliary blade of the first aspect of the present invention. Namely, the auxiliary blades S2 and S3 can operate effectively in forcing the air flow 11A–11B obliquely radially outwardly. Since the auxiliary blade S3 has an attaching angle $\theta_n$ and an exit angle $\beta_n$ greater than those of the first auxiliary blade S2, the auxiliary blade S3 can provide a strong centrifugal flow of air which is guided along the end part of the first auxiliary blade S2 toward the pressure side E of the subsequent fan blade B3. In other words, the provision for the second auxiliary blade S3, a part of the fan blade B3 nearer to the center of rotation of the axial flow fan can be positively utilized for delivering a strong centrifugal flow of air to the pressure side E. Accordingly, a principal part of the resultant flow of air combining the axial flow and the centrifugal flow is directed outwardly from a disturbing object such as the engine 3, and a minor part of the air flow is first blown onto the internal surface of the shroud and then reflected toward the delivering direction.

As a result, the reversing flow from the pressure side to the suction side passing through the clearance C' between the fan F3 and the shroud 13 is prevented, thereby passing almost all of the cooling air flow through the radiator 9 and improving the cooling ability of the cooling system. Since the auxiliary blades S3 and S2 are formed along the stream line on the surface of the fan blade, the auxiliary blades do not disturb the passage of the ram wind 14 caused by the forward movement of the automobile. Thus, the production of the centrifugal flow 11B by the auxiliary blades S2 and S3 and axial flow by the fan blade B3 at the time of rotation of the axial flow fan F3 of the invention in the arrow direction 10 can be high efficiency.

In a typical case, the suction side surface (at a negative pressure) of the fan blade does not contribute a great deal to the blowing effect of the axial flow fan. However, by provision for the auxiliary blades S2 and S3, a definite air flow is created along the suction side surface I, and the turbulence and separation of laminar air flow from the surface can be eliminated or can be at least shifted toward the trailing edge 18B of the fan blade. In this way, the contribution of the blowing effect of the most part of the suction side surface I of the fan blade B3 is made possible, and not only improvement of the blowing efficiency but also a substantial increase in the flow rate can thus be attained. Furthermore, prevention of the separation reduces the eddy noise, thus permitting the provision for a silent fan.

Figure 12:
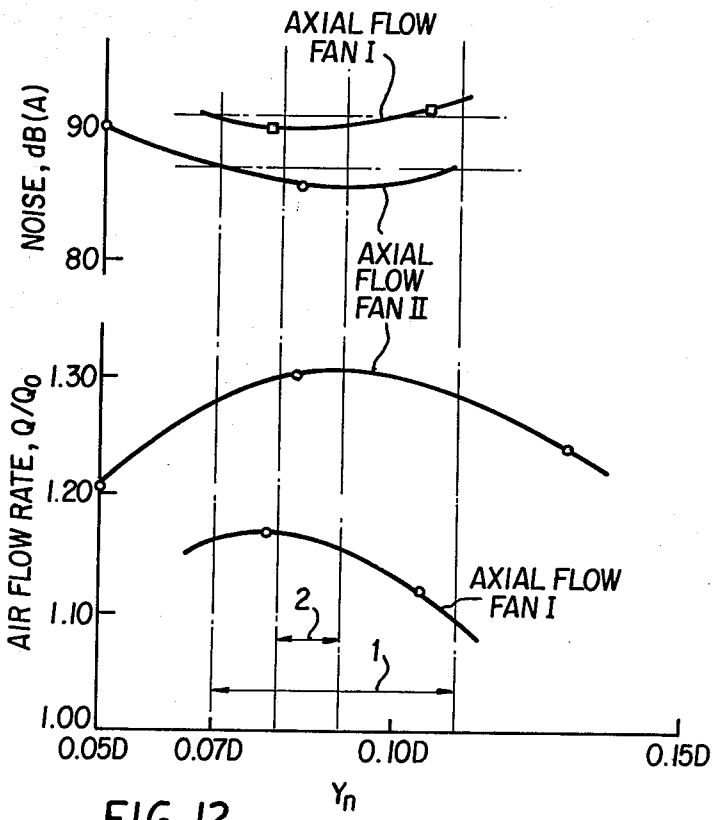
FIGS. 11, 12 and 13 are graphical representations of the characteristics of the second aspect.
Figure 11:
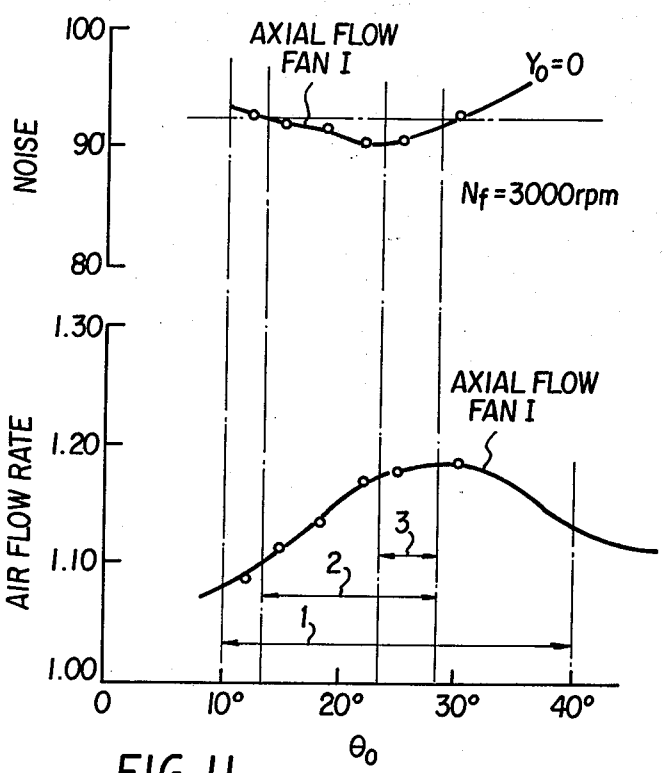
Figure 13:
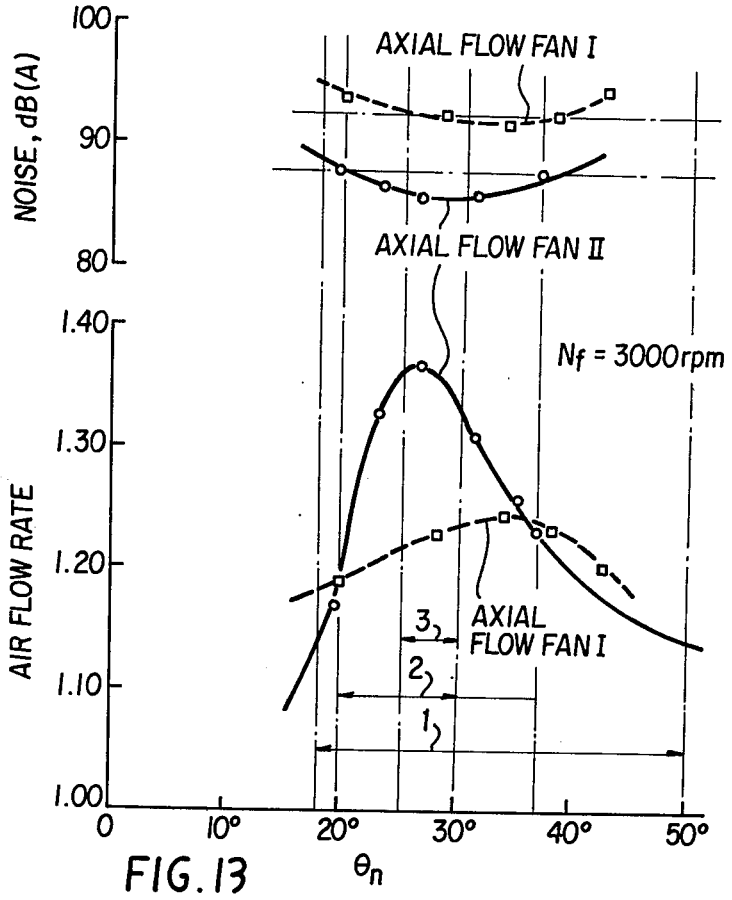

While various experiments were carried out on the second aspect of the present invention, a typical example thereof was for an axial flow fan F3 of the following construction which was applied to an engine room cooling system in an automobile as shown in FIGS. 11–13.

| | Axial Flow Fan | |
|---|---|---|
| | No. I | No. II |
| Outermost dia. D of the fan blade B3 | 380 mm | 360 mm |
| Number of fan blades | 6 | 6 |
| Pitch angle Θ | 40° | 30° |

On both of the above described axial flow fans, auxiliary blades as defined hereinbelow were provided.

(a) Number of auxiliary blades:
two for each fan blade 1 (b) Securing distance of the trailing ends:
$Y_o=0$
$Yn=0.083D$ (c) Attaching angle of the auxiliary blades:
$\theta_o=20°$
$\theta_n=30°$ (d) Inlet angles:

$\alpha_o=5°$
$\alpha_n=12°$
(e) Exit angles:
$\beta_o=26°$
$\beta_n=36°$

It was found that in the axial flow fan with the auxiliary blades as described above, the relative speeds of the air flow delivered from the trailing ends 19B of the auxiliary blades S2 and S3 were high as well as attaining strong obliquely disposed centrifugal flow along the surface of fan blade B3, a maximum flow rate of the axial flow fan, prevention of reversing flow through the clearance C' between the fan and the shroud, and other advantageous aerodynamic performances.

Further experiments and analyses on axial flow fans having various securing distances or attaching angles were carried out to obtain the optimum arrangement of the auxiliary blades with practical satisfactory performances and effects.

For example, axial flow fans with auxiliary blades S2 and S3 in a manner such that $Y_0=0$, $Y_n=0.083D$, $\theta_o=20°$, and $\theta_n$=variable were investigated, and the results are indicated in FIG. 13. As is apparent from FIG. 13, when $\theta_n$ is in a range of from 25° to 35°, a remarkable increase in air flow and considerable lowering of the noise level can be obtained in comparison with a conventional axial flow fan, and when $\theta_n$ is in a range other than the above-mentioned range, the air flow and the noise level are worsened.

The lower limitation with regard to the reduction of $\theta_n$ is 18° and the upper limitation with respect to the elevation of θhd n is 40° because too great a reduction of $\theta_n$ causes a narrower spacing on the inlet side of the auxiliary blades and too great an elevation on $\theta_n$ invites high noise. In other words, when the increasing rate of wind delivery other than that of the conventional axial flow fan is limited to a range from 10% to 15%, and the increase in the noise level is limited below 2 dB (that is, in a range where the noise level of this embodiment is reduced than that of the conventional axial flow fan in comparison on an equal wind delivery basis), a range of from 18° to 50° is suitable for $\theta_n$.

For increasing the air flow by strengthening the centrifugal flow, actual values of $Y_n$ and θhd n are important. Namely, too great a reduction of $Y_n$ causes a narrower spacing on the outlet side of the auxiliary blades, so the wind delivery is decreased, while too great an elevation of $Y_n$ cannot provide the strong oblique air flow, through the wind delivery is increased. For this reason, further experiments have been conducted while $Y_n$ is varied in a range of from 0.05D to 0.15D, and the results are indicated in FIG. 12.

Judging from the experimental results and also from a consideration about the practical usage, it is concluded that a range of from 0.07D to 0.10D is suitable for Y.

Although the securing distance $Y_o$ and the attaching angle $\theta_o$ of the first auxiliary blade S2 have been described in connection with the present invention, the provision for the second auxiliary blade S3 may necessitate some modification. According to further study in this regard it was found that the range of $Y_o$ is satisfactory in the present invention, exhibiting maximum air flow at $Y_o=0$, with the optimum range of $Y_o$ is from 0 to 0.1D, and that the range for the angle $\theta_o$ must be slightly modified. Further experiments were conducted with varied $\theta_o$ while $Y_o$ is maintained at O, and the results are indicated in FIG. 11.

In view of the experimental results, if the preferred range of $\theta_o$ is selected from the standpoint that 10% higher air flow with 1 dB higher noise level is acceptable, a slightly modified range of from 10° to 40° is obtained for $74_o$. The positive sense of the angle $\theta_o$ is in the rotating direction of the fan blade, so the angle $\theta_o$ must therefore be more than O.

In conclusion, an axial flow fan according to the invention is satisfactory in performance when the securing distances $Y_o$ and $Y_n$ of the trailing ends 19B of the auxiliary blades S2 and S3 are selected in the ranges of from 0 to 0.1 D and from 0.07 D to 0.11 D, respectively, wherein D is the fan diameter, and the attaching angles $\theta_o$ and $\theta_n$ of the auxiliary blades S2 and S3 to the fan blade B3 are selected from the ranges of from 10° to 40° and 18° to 50°, respectively.

With regard to the supplementary angles $\theta_o$ and $\theta_n$ of the auxiliary blades of the present invention, the proper ranges for practical use are respectively in the ranges of from 10° to 40° and from 18° to 50° as shown in FIGS. 11 and 13 by the arrow ①. Considering the increase of the air flow rate, the suitable ranges are respectively in ranges of from 13° to 28° and from 20° to 37° as shown in FIGS. 11 and 13 by the arrow ②. Further, by considering the noise level and the air flow rate, the optimum ranges are respectively in ranges of from 23° to 28° and from 25° to 30° as shown in FIGS. 11 and 13 by the arrow ③. On the other hand, with regard to the securing distance $Y_n$ of the auxiliary blade of the present invention, the range starting from 0.07 and ending at 0.11 D is appropriate for practical use as shown in FIG. 12 by the arrow ①. By considering the increase of the air flow rate, the suitable range of $Y_n$ is in a range of from 0.08 D to 0.09 D as shown in FIG. 12 by the arrow ② and the optimum distance is $Y_n=0.083$ D.

Figure 14:
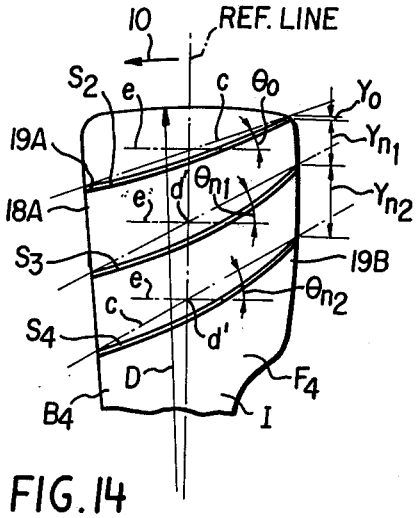
FIG. 14 is a view showing a modification of the second aspect.

Next, a modification of the present invention will be described with reference to FIG. 14. In this modification, three auxiliary blades S2, S3 and S4 are provided on the suction side surface I of each fan blade B4 of an axial flow fan F4 which is preferably of a type having a greater outer diameter (more than 500 mm) or a comparatively small boss part K (spider).

The auxiliary blade S3 provided at an outermost position relative to the rotating axis O of the fan F4 has a securing distance $Y_O$ at its trailing end 19B in a range of from 0 to 0.1 D (D being the diameter of the fan) and an attaching angle $\theta_0$ in a range of from 10° to 40°. The auxiliary blades S3 and S4 provided radially inwardly from the auxiliary blade S2 have securing angles $Y_{n1}$ and $Y_{n2}$ both ranging from 0.07 D to 0.11 D and also attaching angles $\theta_{n1}$ and $\theta_{n2}$ both ranging from 18° to 50°.

By the above-described arrangement, the axial flow fan F4 has an effective area for the entire auxiliary blades S2, S3 and S4 much greater than the above-described basic construction, and can therefore deliver a much greater flow rate at a much higher velocity with advantageous effects similar to those of the basic construction of the afore-mentioned second aspect.

Figure 17:
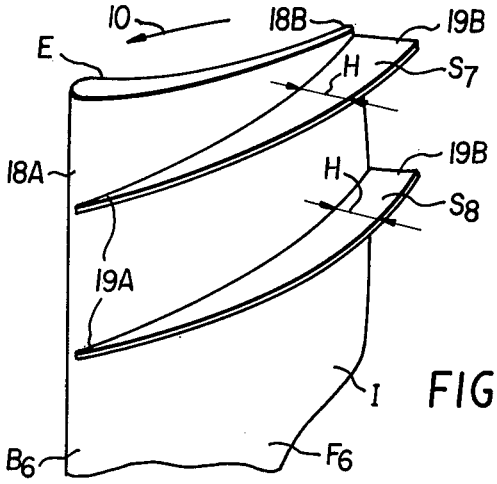
FIGS. 17, 18(*a*)–(*d*) are views showing another modification of the first and second aspects of the invention.
Figure 18A:
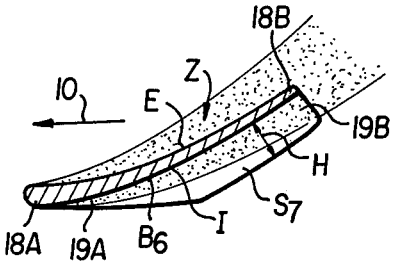
Figure 18B:
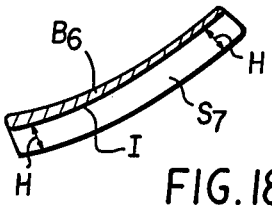
Figure 18C:
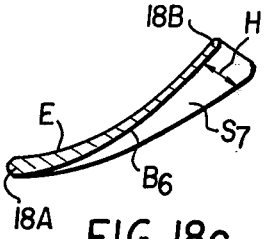
Figure 18D:
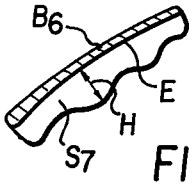
Figure 18E:
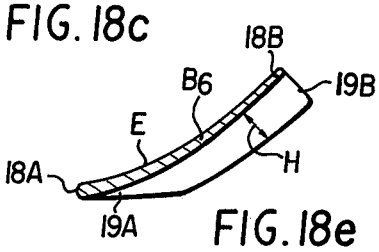

In another modification which is applicable to the aforementioned first and second aspects of the present invention, auxiliary blades S7 and S8 are provided to project perpendicularly from the suction side surface I of the fan blade B6 as shown in FIGS. 17 and 18, and the maximum height H of each of the auxiliary blades is restricted so as to be less than 0.055 D wherein D is the outermost diameter of the fan blade B6. In this modification regarding the height H, although there are various cases such as having a constant height as shown in FIG. 18(*b*), having a constant height only locally as shown in FIGS. 18(*d*), and 18(*e*), and having no constant height as shown in FIGS. 17 and 18(*c*) since the maximum height H of the auxiliary blades S7 and S8 projecting perpendicularly from the suction side surface I and or the delivery side surface E of the fan blade B6 has been restricted to less than 0.055 D, a boundary layer along the surface of fan blade B6 as designated by Z in FIG. 18(*a*) can be effectively controlled.

When the maximum height H is much less than the above-mentioned value, however, the control of the boundary layer becomes almost impossible and the resultant aerodynamic performances become inferior, although there is no problem with regard to the noise level.

On the other hand, when the maximum height H of the auxiliary blades S7 and S8 is in excess of the above-mentioned value, the auxiliary blades S7 and S7 tend to penetrate the boundary layer, thus causing the air flow to be separated or stripped out of the surfaces of the auxiliary blades and degrading the aerodynamic performances and the noise level.

Figure 19:
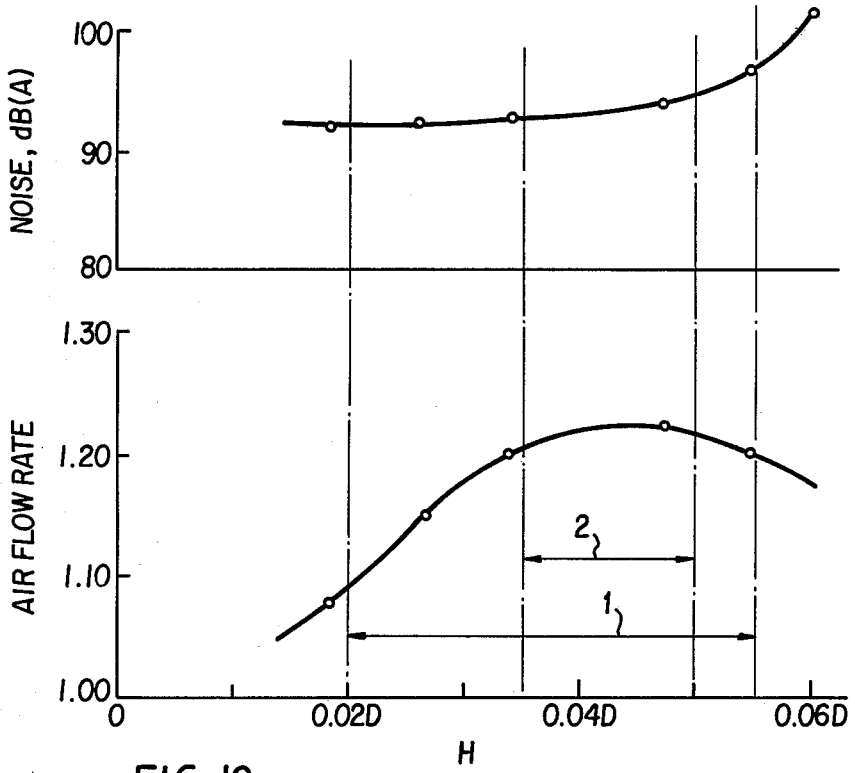
FIG. 19 is a graphical representation of the characteristics of the modification shown in FIGS. 17 and 18(*a*)–(*d*)

As a result of our experiments and analyses relating to the maximum height H of the auxiliary blades, characteristic curves as shown in FIG. 19 were obtained, and it was verified that most advantageous results could be obtained by restricting the maximum height H of the auxiliary blades within the range of from 0.035 D to 0.05 D. Outside of the above-described range, aerodynamic performances worsened, and at a value of H in excess of 0.055 D, degradation of aerodynamical properties, elevation of noise level, and a problem with respect to the strength of the auxiliary blades occurred, thus making it difficult to continue operation of the axial flow fan. The heights H of the auxiliary blades S7 and S8 may not necessarily be the same, but these can be different from each other so long as the heights satisfy a relation of $0.02\ D \leqq H \leqq 0.055\ D$.

Figure 20:
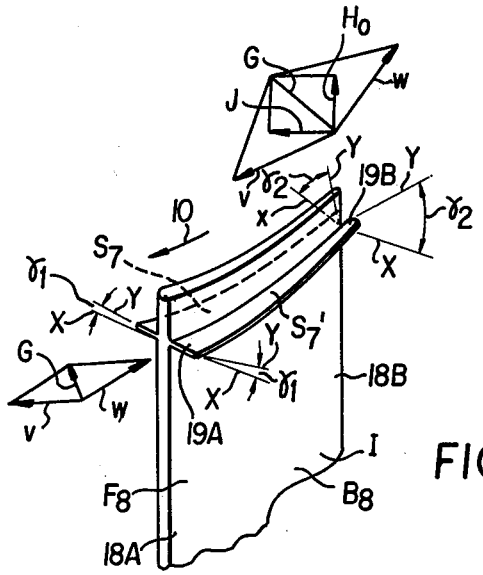
FIGS. 20, 21, and 22 are views showing further modifications of the first and second aspects of the invention.

In still another modification, the auxiliary blades may be perpendicularly provided on not only the suction side surface I but also the pressure side surface E and both of the surfaces. In a further modification, as shown in FIG. 20, the auxiliary blades S7 and S7′ do not project from these surfaces of the fan blade B8 perpendicularly, but rather at an angle directed outwardly from the central axis of the axial flow fan.

More specifically, the auxiliary blades S7 and S7′ provided on both sides of the fan blade B8 extend from the leading edge 18A to the trailing edge 18B of the same blade and, when it is assumed that the X axis extends perpendicularly from the two surfaces I and E of the fan blade B8 and the Y axis extends along the projecting direction of any arbitrary part of the auxiliary blades, the angle formed between the X axis and the Y axis at any part of each auxiliary blade increases from $\gamma_1$ to $\gamma_2$ along the length of the auxiliary blade starting from the leading edge and ending at the trailing edge. In this example, the slanting angles $\gamma_1$ and $\gamma_2$ are selected in a range of;

$$45° \geqq \gamma_2 \geqq \gamma_1 \geqq 0°$$

and more preferably, $r_1$ at the leading end 19A is selected within 0°–10° and $\gamma_2$ at the trailing end 19B is selected within 15°–45°.

In this arrangement, since the auxiliary blades S7′ and S7′ are projecting aslant at the above-described angle, velocity triangles as shown in FIG. 20 are formed. When a triangle formed on the pressure side E at the trailing edge 18B of the fan blade B8 is considered in FIG. 20 only triangles at the auxiliary blade S7 on the suction side I are shown), the triangle has a peripheral velocity component V corresponding to rotation of the fan blade B8 and a relative velocity component w of an air flow along the radially outward surface of the auxiliary blade S7′ on the pressure side, the vector sum of the two components exhibiting an absolute velocity G of the air flow. The absolute velocity G represents the centrifugal flow produced by the auxiliary blade S7′ on the pressure side E. This absolute velocity G can be divided into two components, one being vertical to the surface of the fan blade B8 and the other being in parallel with the same surface. The vertical velocity component J is directed from the tip edge of the projection of the auxiliary blade S7′ toward the surface of the fan blade B8 so that the separation or stripping of the air flow from the surface of the fan blade B8 is thereby prevented. On the other hand, the parallel component Ho considered as the same as the absolute velocity G contributes to the formation of the centrifugal flow of air as described above.

Although the velocity disposition of air flow has been considered for the pressure side auxiliary blade S7′, it is apparent that the same relation is also established for the suction side air flow.

According to the above-described modification of the first and second aspects of the present invention, since the air flow separation can be effectively suppressed at the trailing end 19B of the auxiliary blades S7′ and S7′, a strong centrifugal flow of air can thereby be produced and an axial flow fan adapted for use under comparatively high resistances on the front and rear sides, such as a cooling fan of the automobile, thereof can be obtained. Furthermore, in the axial flow fan F8 of this modification, noises caused by impact and vibration of air flow can be substantially reduced.

Although in the above-described modification, auxiliary blades S7′ and S7′ have been provided on both the suction side I and the pressure side E of the fan blade B8, there may be provided another combination wherein an auxiliary blade, or blades projecting at a varying angle as described above on either of the suction side I or the pressure side E to be extended along the entire width or along one part of the width of the fan blade B8, or still another combination wherein an auxiliary blade or blades projecting at a varying angle as described above may be provided on the suction side I or the pressure side E within auxiliary blade or blades projecting perpendicularly and arranged on the pressure side E or the suction side I in opposition to the former auxiliary blade or blades. It is apparent that the above-described two combinations afford similar advantageous features as those of the above-described modification.

Still another modification also applicable to embodiments of the invention will now be described for the case applied to the embodiment set forth with reference to FIG. 15(*a*). In this modification, auxiliary blades S5 and S6 provided on the suction side I of the fan blade B5 of an axial flow fan F5 are curved radially outwardly along a camber line passing through the leading end 19A and the trailing end 19B, so that the centers of curvature for the auxiliary blades S5 and S6 are located radially outwardly of the blade B5, and the radii R1 and R2 of curvature are selected to be greater than 0.2 D wherein D is the outermost circle diameter of the fan blade B5.

Figure 16:
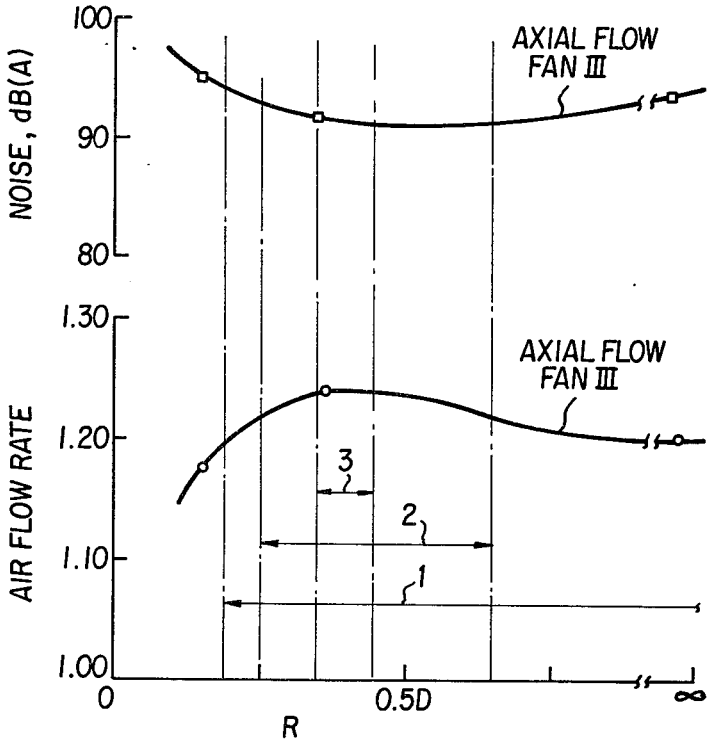
FIG. 16 is a graphical representation of the characteristics of the modification in FIG. 15(*a*)

As a result of experiments and studies, it was found that the radially outwardly curving auxiliary blades were important for obtaining smooth flow of air along the surface of the fan blade B5, improving aerodynamic performances, and for reducing noise level. Furthermore, it was found that the radially outwardly curved auxiliary blades were important in preventing separation and eddy flow. After a number of visualized flow tests around the fan blade, it became clear that a radius of curvature greater than 0.2 D as shown in FIG. 16 by the arrows ①, further in a range of from 0.25 D to 0.65 D as shown in FIG. 1 by the arrow ② was advantageous for the auxiliary blades S5 and S6, and although an airfoil configuration was most suitable, the upturning configuration of the auxiliary blades could be practically satisfactory in view of the mass production suitability. Furthermore, it was found that a range of from 0.35 D to 0.45 D as shown in FIG. 16 by the arrow ③ is most advantageous in considering the nosie level and the air flow rate, for the radii of curvatures of the auxiliary blades S5 and S6, although $R=\infty$, that is, a rectilinear configuration of the auxiliary blades can be used as well with satisfaction.

In the case where the radii of the curvature of the auxiliary blades are smaller than the aforementioned lower limit, the inlet angle $\alpha$ of each blade S5, 6 becomes too small, or even negative i.e. air flow toward the axis of the fan contrary to the centrifugal air is produced in an extreme case, and therefore air flow rate is reduced and the noise tends to be increased. While the exit angle $\beta$ thereof becomes too great, thus deteriorating the aerodynamic performances and the noise level. For this reason, it was found that the lower limit of 0.2 D is preferable for the radius of curvature of each blade.

Herein, an example of the axial flow fans III and IV used in the experiments was as follows:

| | Axial flow fan III | Axial flow fan IV |
|---|---|---|
| 1. Fan o.d. (mm) × blade number × blade securing angle Ⓗ | 380×6×40° | 360×6×30° |
| 2. Auxiliary Blades | | |
| (a) number of the blades: | 2 for each fan blade | |
| (b) radius of curvature R: | | |
| for the outer blade Sr | R1=0.36D | R1=0.36D |
| for the inward blade S6 | R2=0.39D | R2=0.39D |
| (c) inlet angle: | | |
| for the outer blade S5 | $\alpha 1=6°$ | $\alpha 1=5°$ |
| for the inward blade S6 | $\alpha 2=19°$ | $\alpha 2=12°$ |
| (d) exit angle: | | |
| for the outer blade S5 | $\beta 1=30°$ | $\beta 1=26°$ |
| for the inward blade S6 | $\beta 2=48°$ | $\beta 2=36°$ |

*Note:
For conditions otherwise, refer to the axial flow fan described in the embodiment of the second aspect of the invention.

The above-described axial flow fans III and IV having the auxiliary blades S5 and S6, radius of curvature R, and inlet and outlet angles $\alpha$, $\beta$ are found to have advantageous aerodynamic performances and low noise level.

While each of the auxiliary blades S5 and S6 having camber lines were selected to have a thickness in a range of from 2 to 3 mm, more improved results could be obtained by the simultaneous use of an aerofoil configuration of a higher grade. That is, better results could be obtained by the use of NACA aerofoil, Gettingen aerofoil, and the like instead of the aforementioned R configuration. In either of the cases, it is important that the configuration of the curve connecting the leading end 19A and the trailing end 19B is of a kind which does not disturb air flowing along the fan blade of the axial flow fan. More specifically, the best results can be obtained by the selection of a configuration of the auxiliary blade which has the least air resistance, such as less friction and profile resistance, and also the highest lift whereby the air introduced into the leading end part 19A of the auxiliary blade is delivered from the trailing end 19B without producing any turbulence, eddy flow, and separation of the flow. Generally speaking, a selection of thin blade, circular blade, planar blade, and the like will lead to a better result.

Figure 15A:
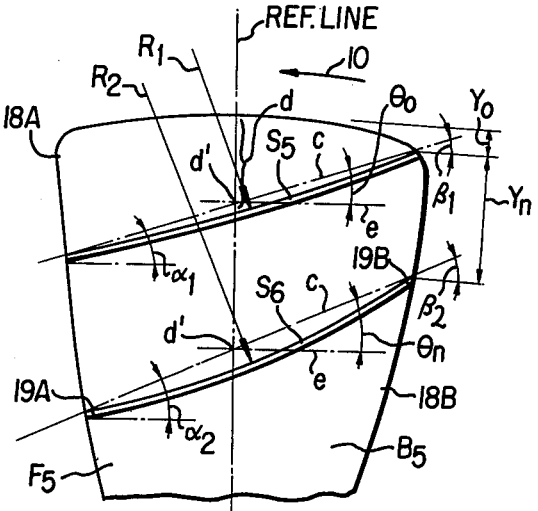
FIGS. 15(*a*), 15(*b*), and 15(*c*) are views showing a modification of the first and second aspects of the invention.
Figure 15B:
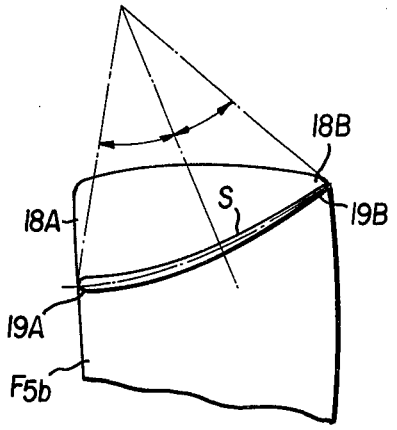
Figure 15C:
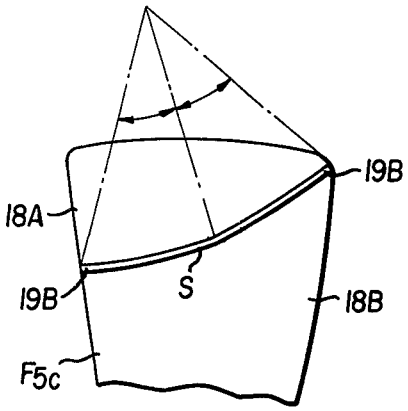

According to our study with respect to the configuration of the auxiliary blades, it was found that there is not much difference between the thin blade and the circular arc blade from the viewpoint of the aerodynamic performances and of noise level, and these may be represented by a circular arc blade as shown in FIG. 15(*a*) having one or more radius of curvature with one or more of center located radially outwardly. This is because the air flow along the surface of the fan blade of the axial flow fan is not two-dimensional, but three-dimensional and therefore much more complicated than that of two-dimensional flow. Thus any special configuration of the auxiliary blade such as a thin blade, which is considered to be advantageous for two-dimensional flow, it not necessarily advantageous for the three-dimensional flow and hence can be replaced by a circular arc blade. The circular arc blade ordinarily has a thickness in a range of from 2 to 5 mm, and the curve connecting the middle point of the thickness at various positions is termed a camber line.

As a result of various experiments about the details of the blade configuration, it was found that not only a simple configuration, but also a complex configuration made of a combination between, for instance, a thin blade (such as NACA or Gottingen aerofoil) and a circular arc blade as shown in FIG. 15(*b*), or a circular arc and a combination of a circular arc and a planar blade as shown in FIG. 15(*c*) may be used for the auxiliary blade, and in these cases the measurements of the circular arc part is defined as described hereinabove. It was also found that the aerodynamic performances and the noise level obtainable by these configurations were substantially equal to each other.

The reference line of the axial flow fan of the above-noted embodiments extends from the central axis of the fan through those points approximately 2/5 times the chord lengths. However, the reference line is never restricted to the abovementioned range. According to the axial flow fan to be applied, the reference line may be a line extending from the central axis of the fan through those points approximately ½ times the chord lengths. Further the reference line may be located at the tip part of the leading edge of the fan blade having flexibility and a curvature backwardly in the direction of the rotation of a fan such as a screw fan.

In the above-embodiments of the axial flow fan of the present invention, the auxiliary blade wherein one auxiliary blade is provided at the outer position in the direction of the diameter of the fan and other auxiliary blade is provided radially inwardly in an unequally spaced apart relation. Besides the above arrangement, the auxiliary blades may be provided in the same manner on the pressure side E or both the suction side I and the pressure side E. Further, the auxiliary blades may be provided on the suction surface I and/or the pressure surface wherein the distances at the leading ends 19A and at the trailing ends 19B are the same (i.e. in an equally spaced apart relation). These modifications have the same performances as the second aspect of the present invention.

Figure 21:
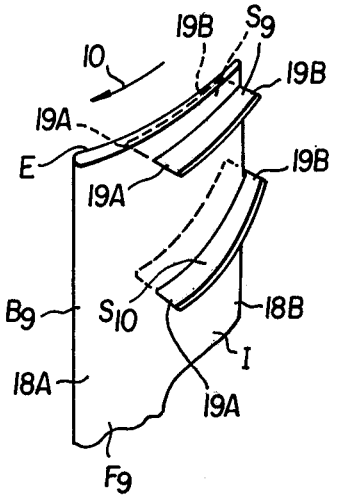
Figure 22:
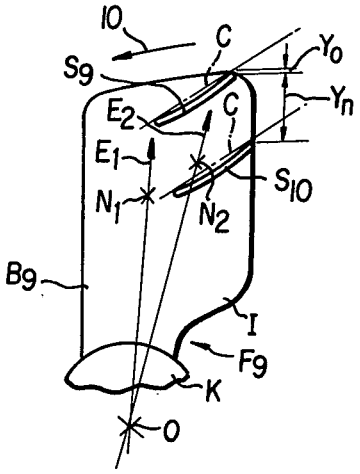

This invention is not necessarily restricted to the above-described construction wherein a plurality of auxiliary blades are extended across the entire width of the fan blade, but it may otherwise be constructed as shown in FIGS. 21 and 22 wherein auxiliary blades S9 and S10 of reduced lengths are provided on both the suction side I and the pressure side E of the fan blade B9 at positions nearer to the trailing edge 18N in such a manner that one of the auxiliary blades S9 is located radially outwardly of the other S10 in an equally spaced apart relation.

In the axial flow fan F9 of this modification, a strong air flow is delivered in the centrifugal direction out of the trailing edge 18B of the fan blade B9 by the auxiliary blades S9 and S10 provided on both the suction side I and the pressure side E of the fan blade B9, and therefore the occurrence of eddy flow and separation of stream at the trailing edge of the blade B9 can be effectively prevented. Furthermore, in the axial flow fan F9 of this modification, the center of gravity normally at a position N1 on the fan blade B9 is moved toward another position N2 near the trailing edge 18B as shown in FIG. 22, and the centrifugal force E2 acting thereto is also increased.

Owing to the thus elevated momentum of the fan blade B9, a deformation is caused in the fan blade B9 as in the above-described embodiments and modifications, thus reducing the driving force required for the axial flow fan F9. This axial flow fan can otherwise afford advantageous features similar to those obtained by the aforementioned embodiments and modifications.

Although in the modification described above, a plurality of auxiliary blades S9 and S10 of short lengths have been provided in an equidistant relation on both the suction side I and the pressure side E, the auxiliary blades S9 and S10 may otherwise be provided on either one or both of the suction side I and the pressure side E of the fan blade B9 at positions near the trailing edge 18B, leading edge 18A, or an intermediate position between the two edges, in an equally or unequally spaced apart relation, and advantageous results substantially equal to those of the above-described embodiments and modifications can be obtained.

Although the auxiliary blades in all of the aforementioned embodiments and modifications may be secured to the fan blade by means of welding, screw-threading, or riveting, the auxiliary blades may preferably be made integrally with the fan blade out of a plastic material. When a cooling fan in automobile is made of a plastic material, care should be exercised against thermal deformation of the fan blade due to the heat of the engine room. Such a problem can be substantially eliminated by the reinforcement offered by provision for the auxiliary blades.

While the invention has been described with respect to an axial flow fan of a suction type adapted for use in a cooling system for the engine housing of a vehicle, it is apparent that the invention is not always restricted to such a type of fan, but it is also applicable to a blower type fan used in buses and other industrial transporting machines, a ventilating fan for domestic or industrial use, and a fan used in an air conditioning system. Likewise, although the invention has been described with respect to a propeller type axial flow fan, it is apparent that the invention is also applicable to an oblique flow fan or a fan having retracting blades.

As will be apparent from the description above, since in the axial flow fan according to this invention, one or more auxiliary blades are provided on the fan blade at an optimum position, aerodynamic preformances of the fan can be substantially improved and the noise level thereof can be substantially reduced. Furthermore, the axial flow fan according to this invention can be used in both a nonpressurized open type mode and a pressurized mode, and more particularly can be used as a cooling fan in an automobile.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An axial flow fan having auxiliary blades which comprises:

a drive source;

a hub rotatably supported and driven by said drive source, a plurality of fan blades extending radially outwardly from said hub, and including a suction surface and a pressure surface; and at least one auxiliary blade projecting from an outer part of at least one of said suction and pressure surfaces of said fan blade, said auxiliary blade having a leading and trailing edge extending in a chordlength direction such that a leading region of the auxiliary blade is located nearer the central axis of the fan than a trailing region of the auxiliary blade wherein, a supplementary angle $\theta_0$ of an angle formed between a chord line connecting the leading edge and a trailing edge of said auxiliary blade and a reference line extending from the central axis of the fan has the relation $$5° \leqq \theta_0 \leqq 40°$$

wherein a distance $Y_0$ from said trailing edge of said auxiliary blade to the radial outermost part of said fan blade has the relation to the diameter D of said fan $$0 \leqq Y_0 \leqq .1D; \text{ and}$$

wherein the maximum height H of said auxiliary blade in a direction perpendicular to said suction or pressure surface of each of said fan blades has the relation to diameter D of said fan $$0.02D \leqq H \leqq 0.055D.$$

2. An axial flow fan having auxiliary blades comprising:

a drive source;

a hub member rotatably supported and driven by said drive source;

a plurality of fan blades extending radially outwardly from said hub member and including a suction and pressure surface; and at least two auxiliary blades projecting from at least one of said suction and pressure surfaces of said fan blades, each of said auxiliary blades having a leading and trailing edge extending in a chord-length direction such that a leading region of the auxiliary blades is located nearer the central axis of the fan than a trailing region of the auxiliary blades wherein, a supplementary angle $\theta_0$ of an angle formed between a chord line connecting the leading edge and a trailing edge of the outermost of said auxiliary blades and a reference line extending from the central axis of the fan has the following relation $$10° \leqq \theta_0 \leqq 40°;$$

wherein a supplementary angle $\theta_n$ of an angle formed between a chord line connecting the leading edge and a trailing edge of the innermost of said auxiliary blades and a reference line extending from the central axis of the fan has the relation $$18° \leqq \theta_n \leqq 50°;$$

wherein a distance $Y_0$ from said trailing edge of the outermost of said auxiliary blades to the radial outermost part of said fan blade has the relation to the diameter D of said fan $$0 \leqq Y_0 0.\phi 1D;$$

and a distance $Y_n$ from said trailing edge of the innermost of said auxiliary blades to said trailing edge of said outermost of said auxiliary blades has the relation to the diameter D of said fan $$0.07D \leqq Y_n \leqq 0.11D; \text{ and}$$

wherein the maximum height H of said auxiliary blades in a perpendicular direction to said suction or pressure surface of each said fan blades has the relation to the diameter D of said fan $$0.02D \leqq H \leqq 0.055D.$$

3. An axial flow fan according to claim 1, wherein: the curvature radius R of said auxiliary blade has the relation to the diameter D of said fan $$R \geqq 0.2D.$$

4. An axial flow fan according to claim 1, which further comprises:

a shroud comprising a thin hollow member having a large opening and a small throttled opening at opposite ends thereof, wherein each of said fan blades are disposed within said shroud from said small throttled opening toward said large opening of said shroud, and an axial inserted width L of said fan blades, which is defined by a point of minimum opening of said small throttled opening and an inserted end portion of said fan blades in the axial direction, and an axial entire width W of said fan blades have the relation $$0 \leqq L \leqq W.$$

5. An axial flow fan according to claim 2, wherein: the curvature radius R of said auxiliary blades have the relation to the diameter D of said fan $$R \geqq 0.2D.$$

6. An axial flow fan according to claim 5, which further comprises:

a shroud comprising a thin hollow member having a large opening and a small throttled opening at opposite ends thereof, wherein said fan blades are disposed within said shroud from said small throttled opening toward said large opening of said shroud, and an axial inserted width L of said fan blades, which is defined by a point of minimum opening of said small throttled opening and an inserted end portion of said fan blades in the axial direction, and an axial entire width W of said fan blades having the relation $$0 \leqq L \leqq W.$$

7. An axial flow fan according to claim 2, wherein: the distance between said two adjacent auxiliary blades is constant.

8. An axial flow fan according to claim 2, wherein: the distance between said two adjacent auxiliary blades at said leading edges thereof in the radial direction of said fan blades is larger than that at said trailing edges thereof.

9. An axial flow fan according to claim 2, wherein: said auxiliary blades are inclined radially outwardly at a predetermined angle with respect to the surfaces of said blades.

10. An axial flow fan according to claim 1, wherein: said auxiliary blade includes an inclined angle $\gamma$ which gradually increases from said leading edge thereof to said trailing edge thereof.

11. An axial flow fan according to claim 10, wherein: said inclined angle $\gamma_1$ at said leading edge of said auxiliary blade and said inclined angle $\gamma_2$ at said trailing edge of said auxiliary blade have the relation;

$$0 \leqq \gamma_1 < \gamma_2 \leqq 45°.$$

12. An axial flow fan according to claim 6, wherein: the distance between said two adjacent auxiliary blades at said leading edges thereof in the radial direction of said fan blades is larger than that at said trailing edges thereof.

13. An axial flow fan according to claim 1, wherein: said auxiliary blade includes a first and second auxiliary blade having an inclined angle $\gamma$ which is gradually increased from said leading edges thereof to said trailing edges thereof; and wherein an inclined angle $\gamma_1$ of a leading edge of said first and second auxiliary blades and an inclined angle $\gamma_2$ of a trailing edge of said first and second auxiliary blades have the relation;

$$0 \leqq \gamma_1 < \gamma_2 \leqq 45°.$$

14. An axial flow fan according to claim 1, wherein: a pitch angle Ⓗ formed between a straight line connecting a leading edge of said fan blade and a trailing edge of said fan blade and a rotational direction of said fan blade has the relation $$10° \leqq Ⓗ \leqq 45°.$$

15. An axial flow fan according to claim 1, wherein: an inlet angle $\alpha$, formed between a line along said leading edge of said auxiliary blade and a line perpendicular to a line connecting to said leading edge and the central axis, has the relation $$0° \leqq \alpha \leqq 15°;$$

and an outlet angle $\beta$, formed between a line along said trailing edge of said auxiliary blade and a line perpendicular to a line connecting to said trailing edge and the central axis has the relation $$15° \leqq \beta \leqq 60°.$$

16. An axial flow fan according to claim 12, wherein: a pitch angle Ⓗ formed between a straight line connecting to a leading edge of each of said fan blades and a trailing edge of each of said fan blades and a rotational direction of said fan blades has the relation $$10° \leqq Ⓗ \leqq 45°.$$

17. An axial flow fan according to claim 16, wherein: an inlet angle $\alpha$, formed between a line along said leading edge of each of said auxiliary blades and a line perpendicular to a line connecting to said leading edge and the central axis, has the relation $$0° \leqq \alpha \leqq 15°;$$

and an outlet angle $\beta$, formed between a line along said trailing edge of each of said auxiliary blades and a line perpendicular to a line connecting to said trailing edge and the central axis, has the relation $$15° \leqq \beta \leqq 60°.$$

18. An axial flow fan according to claim 1, wherein: said supplementary angle $\theta_0$ of said auxiliary blade has the relation $$10° \leqq \theta_0 \leqq 35°.$$

19. An axial flow fan according to claim 1, wherein: said supplementary angle $\theta_0$ of said auxiliary blade has the relation $$17° \leqq \theta_0 \leqq 33°.$$

20. An axial flow fan according to claim 1, wherein: said supplementary angle $\theta_0$ of said auxiliary blade has the relation $$20° \leqq \theta_0 \leqq 25°.$$

21. An axial flow fan according to claim 1, wherein: said distance $Y_0$ has the relation $$0 \leqq Y_0 \leqq 0.05D.$$

22. An axial flow fan according to claim 1, wherein: said distance $Y_0$ is 0.

23. An axial flow fan according to claim 2, wherein: said supplementary angle $\theta_0$ has the relation $$13° \leqq \theta_0 \leqq 28°;$$

and said supplementary angle $\theta_n$ has the relation $$20° \leqq \theta_n \leqq 37°.$$

24. An axial flow fan according to claim 2, wherein: said supplementary angle $\theta_0$ has the relation $$23° \leqq \theta_0 \leqq 28°;$$

and supplementary angle $\theta_n$ has the relation $$25° \leqq \theta_n \leqq 30°.$$

25. An axial flow fan according to claim 2, wherein: the distance $Y_0$ has the relation $$0 \leqq Y_0 \leqq 0.05D;$$

and the distance $Y_n$ has the relation $$0.08D \leqq Y_n \leqq 0.09D.$$

26. An axial flow fan according to claim 2, wherein: the distance $Y_0$ is 0; and
the distance $Y_n$ is 0.083D.

27. An axial flow fan according to claim 1, wherein: said maximum height H has the relation to the diameter D of each of said fan blades $$0.035D \leqq H \leqq 0.05D.$$

28. An axial flow fan according to claim 2, wherein: said maximum height H has the relation to the diameter D of each of said fan blades $$0.035D \leqq H \leqq 0.05D.$$

29. An axial flow fan according to claim 3, wherein: said curvature radius R has the relation to the diameter D of each of said fan blades $$0.25D \leqq R \leqq 0.65D.$$

30. An axial flow fan according to claim 3, wherein: said curvature radius R has the relation to the diameter D of said blade $$0.035D \leqq R \leqq 0.45D.$$

31. An axial flow fan according to claim 1, wherein: said auxiliary blade is disposed on said suction surface of each said fan blades.

32. An axial flow fan according to claim 1, wherein: said auxiliary blade is disposed on said pressure surface of each of said fan blades.

33. An axial flow fan according to claim 1, wherein: said at least one auxiliary blade comprises first and second auxiliary blades respectively disposed on said suction and pressure surfaces of each of said fan blades.

34. An axial flow fan according to claim 31, which further comprises:

a shroud comprising a thin hollow member having a large opening and a small throttled opening at opposite ends thereof, said fan blades beng disposed within said shroud from said small throttled opening toward said large opening of said shroud, and an axial inserted width L of said fan blades, which is defined by a point of minimum opening of said small throttled opening and an inserted end portion of said fan blades in the axial direction, and an axial entire width W of said fan blades having the relation $$0 \leqq L \leqq W.$$

35. An axial flow fan according to claim 34, wherein said fan blades comprise four fan blades;

the diameter of said fan blades is 380 mm;

the pitch angle Ⓗ formed between a straight line connecting a leading edge of each of said fan blades and a trailing edge of each of said fan blades and a rotational direction of said fan blades has the relation $$10° \leqq Ⓗ \leqq 45°;$$

an inlet angle $\alpha$, formed between a line along said leading edge of said auxiliary blade and a line perpendicular to a line connecting to said leading edge and central axis has the relation $$0° \leqq \alpha \leqq 15°;$$

an outlet angle $\beta$, formed between a line along said trailing edge of said auxiliary blade and a line perpendicular to a line connecting to said trailing edge and central axis has the relation $$15° \leqq \beta \leqq 60°;$$

and the clearance between an inner wall of said shroud and an outermost part of each of said fan blades is 20 mm.

36. An axial flow fan according to claim 17, wherein: said at least two auxiliary blades comprise two auxiliary blades disposed on said suction surface of each of said fan blades.

37. An axial flow fan according to claim 41, wherein said distance $Y_0$ is 0;
said distance $Y_n$ is 0.083D;
said supplementary angle $\theta_0$ is 20°;
said supplementary angle $\theta_n$ is 30°;
said inlet angle $\alpha_0$ is 5°;
said inlet angle $\alpha_n$ is 12°;
said outlet angle $\beta_0$ is 26°; and
said outlet angle $\beta_n$ is 36°.

38. An axial flow fan according to claim 37, wherein: said plurality of fan blades comprise six fan blades having a diameter of 380 mm; and
said pitch angle Ⓗ is 40°.

39. An axial flow fan according to claim 37, wherein: said plurality of fan blades comprise six fan blades having a diameter of 360 mm; and
said pitch angle Ⓗ is 30°.

40. An axial flow fan according to claim 17, wherein: said plurality of auxiliary blades comprise three auxiliary blades disposed on said suction surface of each of said fan blades.

41. An axial flow fan according to claim 36, wherein; said plurality of fan blades comprise six fan blades having a diameter of 380 mm;
said pitch angle Ⓗ is 40°;
the curvature radius $R_1$ of said first auxiliary blade is 0.36D;
the curvature radius $R_2$ of said second auxiliary blade is 0.39D;
the inlet angle $\alpha_1$ of said first auxiliary blade is 6°;
the inlet angle $\alpha_2$ of said second auxiliary blade is 19°;
the outlet angle $\beta_1$ of said first auxiliary blade is 30°; and
the outlet angle $\beta_2$ of said second auxiliary blade is 48°.

42. An axial flow fan according to claim 36, wherein: said plurality of fan blades comprise six fan blades having a diameter of 360 mm;
said pitch angle Ⓗ is 30°;
said curvature radius $R_1$ of said first auxiliary blade is 0.36D;
said curvature radius $R_2$ of said second auxiliary blade is 0.39D;
the inlet angle $\alpha_1$ of said first auxiliary blade is 5°;
the inlet angle $\alpha_2$ of said second auxiliary blade is 12°;
the outlet angle $\beta_1$ of said first auxiliary blade is 26°; and
the outlet angle $\beta_2$ of said second auxiliary blade is 36°.

43. An axial flow fan according to claim 36, wherein: said auxiliary blades are provided at the trailing region of said suction surface of each of said fan blades.

44. An axial flow fan having auxiliary blades which comprises:

a drive source;

a hub rotatably supported and driven by said drive source;

a plurality of fan blades extending radially outwardly from said hub, and including a suction and pressure surface; and at least two auxiliary blades projecting from an outer part of at least one of said suction and pressure surfaces of each of said fan blades, each of said auxiliary blades having a leading and trailing edge extending in a chord-length direction such that a leading region of each of the auxiliary blades is located nearer the central axis of the fan than a trailing region of each of the auxiliary blades wherein, the distance between said two adjacent auxiliary blades at the leading edge thereof in the radial direction of said fan blades is larger than that at the trailing edge thereof, and a supplementary angle $\theta_0$ of an angle formed between a chord line connecting the leading edge and the trailing edge of the outermost of said auxiliary blades and a reference line extending from the central axis of the fan has the relation;

$$5° \leqq \theta_0 \leqq 40°.$$

45. An axial flow fan according to claim 44, wherein a distance $Y_0$ from said trailing edge of each of said auxiliary blades to the radial outermost part of each of said fan blades has the relation to the diameter D of said fan;

$$0 \leqq Y_0 \leqq 0.1D.$$

46. An axial flow fan according to claim 44, wherein; said supplementary angle $\theta_0$ has the following relation;

$$10° \leqq \theta_0 \leqq 40°$$

and wherein a supplementary angle $\theta_n$ of an angle formed between a chord line connecting the leading edge and the trailing edge of the innermost of said auxiliary blades and a reference line extending from the central axis of the fan has the relation;

$$18° \leqq \theta_n \leqq 50°.$$

47. An axial flow fan according to claim 44, wherein the curvature radius R of each of said auxiliary blades has the relation to the diameter D of said fan;

$$R \geqq 0.2D.$$

48. An axial flow fan according to claim 44, which further comprises:

a shroud comprising a thin hollow member having a large opening and a small throttled opening at opposite ends thereof, wherein each of said fan blades is disposed within said shroud from said small throttled opening toward said large opening of said shroud, and an axial inserted width L of each of said fan blades, which is defined by a point of minimum opening of said small throttled opening and an inserted end portion of each of said fan blades in the axial direction, and an axial entire width W of each of said fan blades have the relation;

$$0 \leqq L \leqq W.$$

49. An axial flow fan according to claim 46, wherein; said auxiliary blades are inclined radially outwardly at a predetermined angle with respect to the surfaces of said fan blades.

50. An axial flow fan according to claim 44, wherein; each of said auxiliary blades includes an inclined angle $\gamma_1$ which gradually increases from said leading edge thereof to said trailing edge thereof.

51. An axial flow fan according to claim 50, wherein said inclined angle $\gamma_1$ of said leading edge of said auxiliary blade and said inclined angle $\gamma_2$ of said leading edge of said auxiliary blade have the relation;

$$0 \leqq \gamma_1 < \gamma_2 \leqq 45°.$$

52. An axial flow fan according to claim 44, wherein a pitch angle Ⓗ formed between a straight line connecting a leading edge of each of said fan blades and a trailing edge of each of said fan blades and a rotational direction of said fan blades has the relation;

$$10° \leqq Ⓗ \leqq 45°.$$

53. An axial flow fan according to claim 44, wherein an inlet angle $\alpha$, formed between a line along said leading edge of each of said auxiliary blades and a line perpendicular to a line connecting to said leading edge and the central axis, has the relation;

$$0° \leqq \alpha \leqq 15°$$

and an outlet angle $\beta$, formed between a line along said trailing edge of each of said auxiliary blades and a line perpendicular to a line connecting to said trailing edge and the central axis has the relation;

$$15° \leqq \beta \leqq 60°.$$

54. An axial flow fan according to claim 44, wherein; said supplementary angle $\theta_0$ of each of said auxiliary blades has the relation;

$$10° \leqq \theta_0 \leqq 35°.$$

55. An axial flow fan according to claim 44, wherein said supplementary angle $\theta_0$ of each of said auxiliary blades has the relation;

$$17° \leqq \theta_0 \leqq 33°.$$

56. An axial flow fan according to claim 44, wherein said supplementary angle $\theta_0$ of each of said auxiliary blades has the relation;

$$20° \leqq \theta_0 \leqq 25°.$$

57. An axial flow fan according to claim 45, wherein said distance $Y_0$ has the relation;

$$0 \leqq Y_0 \leqq 0.05D.$$

58. An axial flow fan according to claim 45, wherein said $Y_0$ is 0.

59. An axial flow fan according to claim 46, wherein said supplementary angle $\theta_0$ has the relation;

$$13° \leqq \theta_0 \leqq 28°,$$

and said supplementary angle $\theta_n$ has the relation;

$$20° \leqq \theta_n \leqq 37°.$$

60. An axial flow fan according to claim 46, wherein said supplementary angle $\theta_0$ has the relation;

$$23° \leqq \theta_0 \leqq 28°,$$

and said supplementary angle $\theta_n$ has the relation;

$$25° \leqq \theta_n \leqq 30°.$$

61. An axial flow fan according to claim 47, wherein said curvature radius R has the relation to the diameter D of each of said fan blades;

$$0.25D \leqq R \leqq 0.65D.$$

62. An axial flow fan according to claim 47, wherein said curvature radius R has the relation to the diameter D of each of said fan blades;

$$0.035D \leqq R \leqq 0.45D.$$

63. An axial flow fan according to claim 44, wherein: a distance $Y_0$ from said trailing edge of the outermost of said auxiliary blades to the radial outermost part of said fan blade has the relation to the diameter D of said fan $$0 \leqq Y_0 \leqq 0.1D$$

and a distance $Y_n$ from said trailing edge of the innermost of said auxiliary blades to said trailing edge of said outermost of said auxiliary blades has the relation to the diameter D of said fan $$0.07D \leqq Y_n \leqq 0.11D.$$

64. An axial flow fan according to claim 44, wherein the maximum height H of said auxiliary blades in a perpendicular direction to said suction or pressure surface of each said fan blades has the relation to the diameter D of said fan $$0.02D \leqq H \leqq 0.055D.$$

* * * * *

UNITED STATES PATENT AND TRADEMARK OFFICE

CERTIFICATE OF CORRECTION

PATENT NO. : 4,265,596

DATED : May 5, 1981

INVENTOR(S) : Haruo Katagiri et al.

It is certified that error appears in the above—identified patent and that said Letters Patent is hereby corrected as shown below:

Column 22, line 53, should read --- $0 \leqq Y_0 \leqq 0.1D$ ---.

Column 23, line 30, should read --- $0 \leqq Y_0 \leqq 0.1D$ ---.

Column 27, line 31, "41" should read --- 36 ---.

Signed and Sealed this

*Third* Day of *November 1981*

[SEAL]

*Attest:*

GERALD J. MOSSINGHOFF

*Attesting Officer*

*Commissioner of Patents and Trademarks*